US009831556B2

(12) United States Patent
Yamagajo et al.

(10) Patent No.: US 9,831,556 B2
(45) Date of Patent: Nov. 28, 2017

(54) PLANAR ANTENNA

(71) Applicant: FUJITSU LIMITED, Kawasaki-shi, Kanagawa (JP)

(72) Inventors: Takashi Yamagajo, Yokosuka (JP); Manabu Kai, Yokohama (JP); Andrey S. Andrenko, Foshan (CN)

(73) Assignee: FUJITSU LIMITED, Kawasaki (JP)

( * ) Notice: Subject to any disclaimer, the term of this patent is extended or adjusted under 35 U.S.C. 154(b) by 200 days.

(21) Appl. No.: 14/530,217

(22) Filed: Oct. 31, 2014

(65) Prior Publication Data

US 2015/0123852 A1 May 7, 2015

(30) Foreign Application Priority Data

Nov. 7, 2013 (JP) ..... 2013-231391

(51) Int. Cl.

| | |
|---|---|
| ***H01Q 1/38*** | (2006.01) |
| ***H01Q 9/04*** | (2006.01) |
| ***H01Q 1/22*** | (2006.01) |
| ***H01Q 13/20*** | (2006.01) |

(52) U.S. Cl.
CPC ..... *H01Q 9/0407* (2013.01); *H01Q 1/2216* (2013.01); *H01Q 13/206* (2013.01)

(58) Field of Classification Search
CPC .. H01Q 9/0457; H01Q 13/206; H01Q 21/065; H01Q 9/0407; H01Q 1/2216; H01Q 1/24; H01Q 1/38
USPC ..... 343/700 MS, 829, 846, 848
See application file for complete search history.

(56) References Cited

U.S. PATENT DOCUMENTS 4,063,245 A 12/1977 James et al.
5,076,655 A * 12/1991 Bridges ..... G02F 1/0356 343/824
5,712,643 A * 1/1998 Skladany ..... H01Q 1/38 343/700 MS (Continued)

FOREIGN PATENT DOCUMENTS

DE 28 24 053 A1 12/1978
DE 10 2010 040 793 A1 3/2012

(Continued)

OTHER PUBLICATIONS

Lecher lines: https://en.wikipedia.org/wiki/Lecher_lines[Sep. 8, 2016 8:24:58 PM].*

(Continued)

*Primary Examiner* — Tho G Phan
(74) *Attorney, Agent, or Firm* — Arent Fox LLP

(57) ABSTRACT

A planar antenna includes a substrate formed of a dielectric; a distributed constant line formed on a first surface of the substrate, the distributed constant line including a first end to which power is supplied and a second end that is an open end or is grounded; and at least one first resonator arranged on the first surface of the substrate and within a range in which the at least one first resonator is allowed to be electromagnetically coupled to the distributed constant line in a vicinity of any of nodal points of a standing wave of a current that flows through the distributed constant line in response to a radio wave having a certain design wavelength radiated from the distributed constant line or received by the distributed constant line.

11 Claims, 20 Drawing Sheets

(56) References Cited

U.S. PATENT DOCUMENTS

| | | | | |
|---|---|---|---|---|
| 6,281,843 | B1 * | 8/2001 | Evtioushkine | H01Q 1/38 343/700 MS |
| 6,424,298 | B1 * | 7/2002 | Nishikawa | H01Q 21/0037 343/700 MS |
| 6,798,384 | B2 * | 9/2004 | Aikawa | H01Q 13/106 343/700 MS |
| 8,558,748 | B2 * | 10/2013 | Chen | H01Q 19/30 343/792.5 |
| 9,054,428 | B2 * | 6/2015 | Fukunaga | H01Q 9/04 |
| 2003/0063032 | A1 | 4/2003 | Usui et al. | |
| 2007/0262903 | A1 | 11/2007 | Yamada et al. | |
| 2010/0045549 | A1 | 2/2010 | Shi | |
| 2010/0171666 | A1 * | 7/2010 | Mizutani | H01Q 21/065 343/700 MS |
| 2011/0090130 | A1 | 4/2011 | Choi et al. | |
| 2013/0222204 | A1 | 8/2013 | Binzer et al. | |
| 2016/0079674 | A1 * | 3/2016 | Okunaga | H01Q 1/38 343/737 |

FOREIGN PATENT DOCUMENTS

| | | | | |
|---|---|---|---|---|
| EP | 0 289 085 | A2 | 11/1988 | |
| EP | 1058339 | A1 | 12/2000 | |
| GB | 1 572 273 | | 7/1980 | |
| GB | 1572273 | * | 7/1980 | H01Q 9/0457 |
| JP | 55-097703 | | 7/1980 | |
| JP | 55-132107 | | 10/1980 | |
| JP | H01-93203 | A | 4/1989 | |
| JP | 4-287410 | A | 10/1992 | |
| JP | 2002-271135 | A | 9/2002 | |
| JP | 2007-306438 | A | 11/2007 | |
| JP | 2011-087296 | A | 4/2011 | |

OTHER PUBLICATIONS

Extended European Search Report dated Mar. 26, 2015 for corresponding European Patent Application No. 14191449.9.

Chinese Office Action of related Chinese Patent Application No. 201410601676.6 dated Dec. 2, 2016.

Chinese Office Action of related Chinese Patent Application No. 201410601676.6 dated Jul. 18, 2017.

Japanese Office Action of related Japanese Patent Application No. 2013-231391 dated Aug. 1, 2017.

"Antenna Engineering Handbook," Second Edition, Ohmsha, pp. 259-260, 2008.

* cited by examiner

PLANAR ANTENNA

CROSS-REFERENCE TO RELATED APPLICATION

This application is based upon and claims the benefit of priority of the prior Japanese Patent Application No. 2013-231391, filed on Nov. 7, 2013, the entire contents of which are incorporated herein by reference.

FIELD

The embodiments discussed herein are related to for example, a planar antenna.

BACKGROUND

Radio identification (RFID) systems have been widely used in recent years. Typical examples of RFID systems include systems that use electromagnetic waves equivalent to a UHF band (900 MHz band) or microwaves (2.45 GHz) as communication media, and systems that use mutual induction magnetic fields. Among such systems, RFID systems that use electromagnetic waves in the UHF band have attracted much attention because these RFID systems have relatively long distances over which communication is possible.

As antennas that may be used in order for a tag reader to communicate with radio frequency identification tags using UHF-band electromagnetic waves, microstrip antennas in which a microstrip line is utilized as an antenna have been proposed (see Japanese Laid-open Patent Publication No. 4-287410 and Japanese Laid-open Patent Publication No. 2007-306438). Note that the radio frequency identification tag will be referred to as an "RFID tag" hereinafter for the sake of explanatory convenience.

SUMMARY

According to an aspect of the invention, a planar antenna includes a substrate formed of a dielectric; a distributed constant line formed on a first surface of the substrate, the distributed constant line including a first end to which power is supplied and a second end that is an open end or is grounded; and at least one first resonator arranged on the first surface of the substrate and within a range in which the at least one first resonator is allowed to be electromagnetically coupled to the distributed constant line in a vicinity of any of nodal points of a standing wave of a current that flows through the distributed constant line in response to a radio wave having a certain design wavelength radiated from the distributed constant line or received by the distributed constant line.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A method for commodities management or articles management has been proposed in which a tag reader communicates with a RFID tag attached to an article on a shelf through an antenna provided on the shelf.

Such an antenna integrated into the shelf is called a shelf antenna. The shelf antenna is preferable to form a uniform and strong electric field in the vicinity of the surface of the shelf antenna for radio waves having a specific frequency used for communication so that the shelf antenna may communicate with RFID tags of articles placed anywhere on the shelf in which the shelf antenna is integrated.

Accordingly, it is desired to provide a planar antenna that may improve the uniformity in electric field and increase the electric field intensity in the vicinity of the surface of an antenna.

Hereinafter, a planar antenna will be described according to various embodiments with reference to the accompanying drawings. The planar antenna utilizes, as a microstrip antenna, a microstrip line including an electrical conducting wire or a conducting wire having one end connected to a feeding point and the other end being an open end or being shorted to a ground electrode. Therefore, in the planar antenna, a current flowing through the microstrip antenna is reflected by the other end of the conducting wire, and thereby the current forms a standing wave. At a nodal point of the standing wave, the flowing current is minimized and the intensity of an electric field around the nodal point is maximized. Accordingly, in the planar antenna, at least one resonator is arranged within a range in which the at least one resonator electromagnetically couples to the microstrip antenna in the vicinity of any of nodal points of the standing wave, on the same plane as the conducting wire that forms the microstrip. Thus, the planar antenna may improve the uniformity and the intensity of an electric field in the vicinity of the antenna surface.

In embodiments described hereinafter, each planar antenna disclosed herein is formed as a shelf antenna. However, each planar antennas disclosed herein may be used for application purposes other than the shelf antenna, for example, as various near-field antennas utilized for communication with RFID tags.

Figure 1:
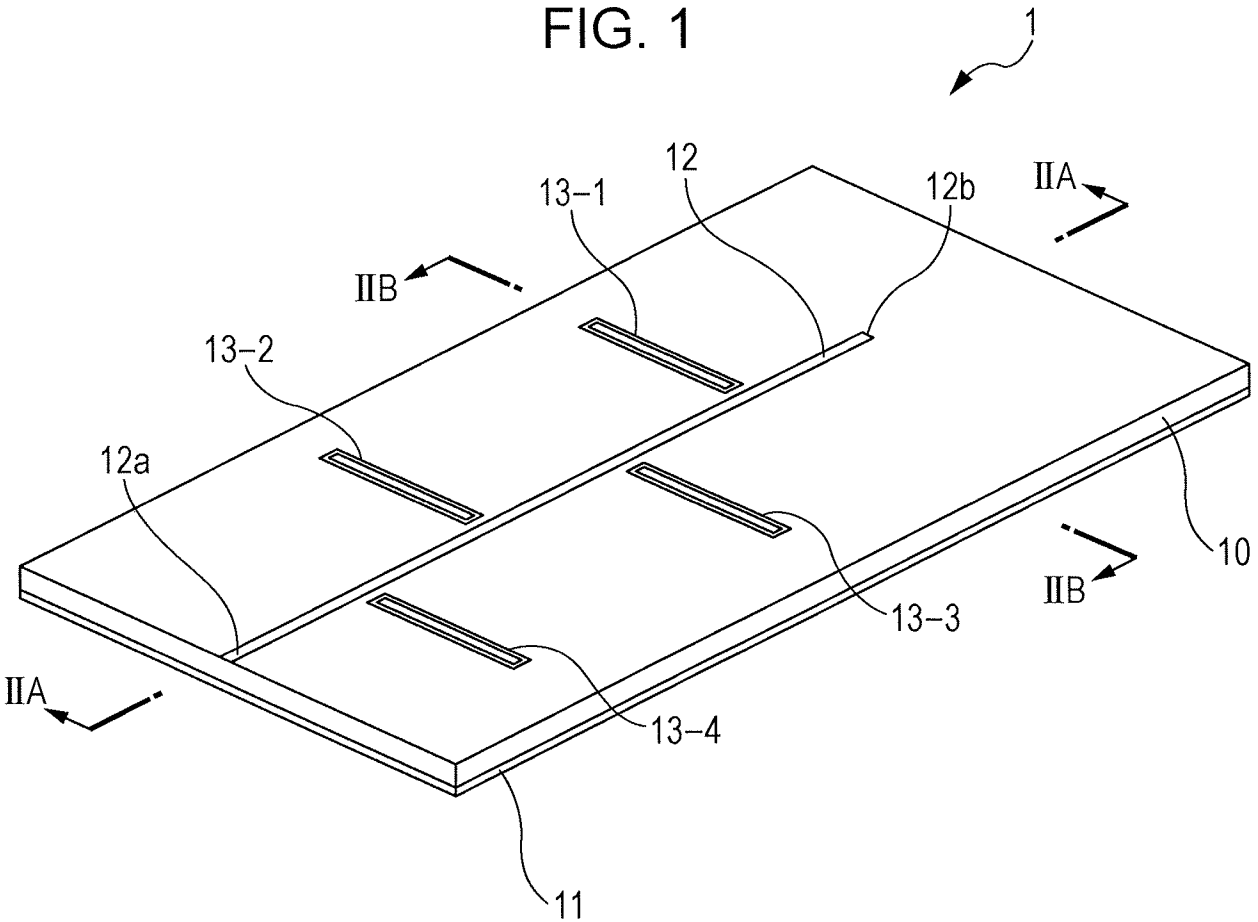
FIG. 1 is a perspective view of a shelf antenna according to a first embodiment.
Figure 2A:
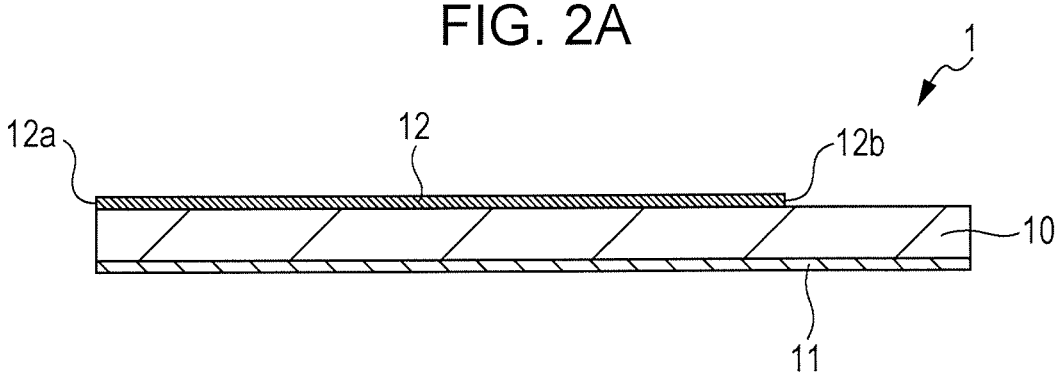
FIG. 2A is a side sectional view of the shelf antenna seen from the direction of arrows along the line IIA-IIA in FIG. 1.
Figure 2B:
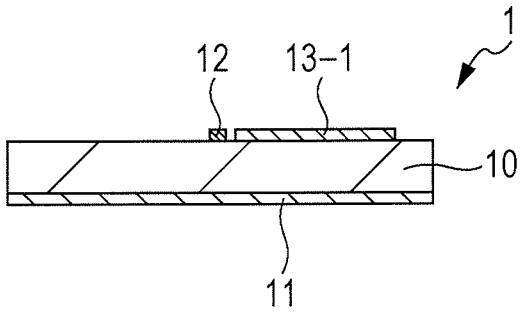
FIG. 2B is a side sectional view of the shelf antenna seen from the direction of arrows along the line IIB-IIB in FIG. 1.
Figure 3:
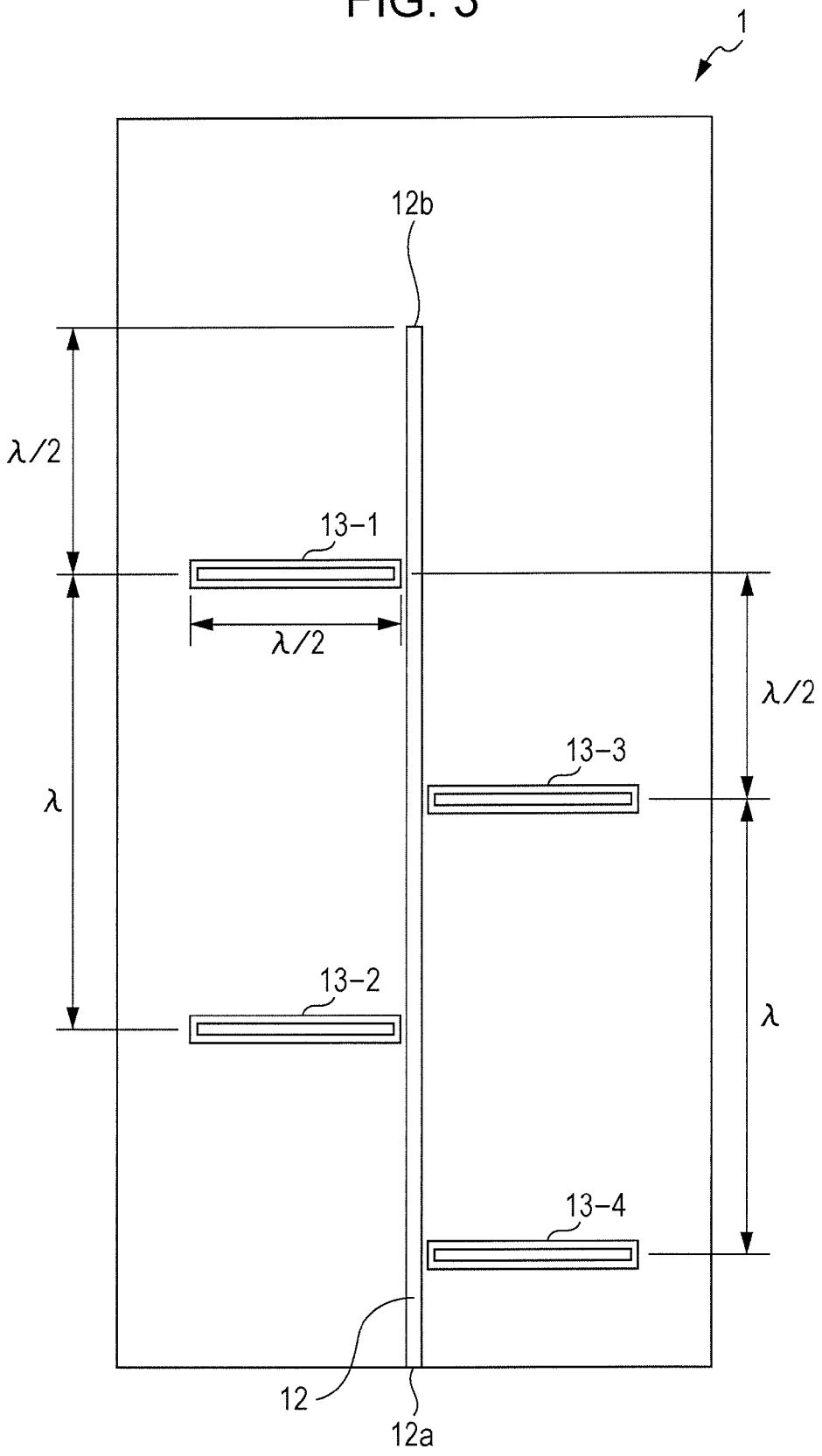
FIG. 3 is a plan view of the shelf antenna depicted in FIG. 1.

FIG. 1 is a perspective view of a shelf antenna according to a first embodiment, and FIG. 2A is a side sectional view of the shelf antenna seen from the direction of arrows along the line IIA-IIA in FIG. 1. FIG. 2B is a side sectional view of the shelf antenna seen from the direction of arrows along the line IIB-IIB in FIG. 1. FIG. 3 is a plan view of the shelf antenna depicted in FIG. 1.

A shelf antenna 1 includes a substrate 10, a ground electrode 11 provided on a lower surface of the substrate 10, a conductor provided on an upper face of the substrate 10, and a plurality of resonators 13-1 to 13-4 provided on the same plane as the conductor 12.

The substrate 10 supports the ground electrode 11, the conductor 12, and the resonators 13-1 to 13-4. The substrate 10 is formed of a dielectric, and therefore the ground electrode 11 is isolated from the conductor 12 and the resonators 13-1 to 13-4. For example, the substrate 10 is formed of a glass epoxy resin such as Flame Retardant Type 4 (FR-4). Alternatively, the substrate 10 may be formed of another dielectric that may be formed into layer form. The thickness of the substrate 10 is determined so that the characteristic impedance of the shelf antenna 1 has a certain or predetermined value, for example, 50Ω or 75Ω.

The ground electrode 11, the conductor 12, and the resonators 13-1 to 13-4 are formed of metal, such as copper, gold, silver, or nickel, or an alloy thereof, or another electric conductive material. The ground electrode 11, the conductor 12, and the resonators 13-1 to 13-4, as illustrated in FIG. 1, FIGS. 2A and 2B, are fixed onto the lower surface or the upper surface of the substrate 10 by, for example, etching or adhesion.

The ground electrode 11 is a flat and grounded conductor, and is provided in such a manner as to cover the entire lower surface of the substrate 10.

The conductor 12 is a linear conductor provided on the upper surface of the substrate 10, and is arranged substantially in parallel with the longitudinal direction of the substrate 10 and at a position at which the substrate 10 is divided substantially in half along the transverse direction thereof, as illustrated in FIG. 1. One end of the conductor 12 serves as a feeding point 12*a*, and is connected to a communication circuit (not depicted) that processes radio signals radiated or received through the shelf antenna 1. The other end 12*b* of the conductor 12 is an open end. The conductor 12, the ground electrode 11, and the substrate 10 together form a microstrip line which functions as a microstrip antenna and is an example of a distribution constant line.

Since the end point 12*b* of the conductor 12 is an open end, a radio wave radiated from the microstrip antenna, or a radio wave received by the microstrip antenna causes a current flowing through the conductor 12 to form a standing wave. Therefore, nodal points of the standing wave are formed at positions apart from the end point 12*b* of the conductor 12, that is, from the open end of the microstrip antenna by distances corresponding to integral multiples of a half of the radio wave. Note that since the conductor 12 is arranged on the upper surface of the substrate 10, which is a dielectric, the wavelength of radio waves on the substrate 10 is shorter in accordance with the relative permittivity of the substrate 10 as compared with the wavelength in the air. At each nodal point of the standing wave, the current is minimized, and a relatively strong electric field is formed around that nodal point. Note that the wavelength of radio waves radiated from a microstrip antenna or received by a microstrip antenna will be referred to as a "design wavelength" hereinafter for the sake of convenience. The design wavelength is represented by λ.

Each of the resonators 13-1 to 13-4 is formed of a loop-shaped conductor that has a length substantially equal to a half of the design wavelength along the longitudinal direction of the resonator and in which the length of one round is substantially equal to the design wavelength, and is provided on the upper surface of the substrate 10. In other words, the conductor 12 and the resonators 13-1 to 13-4 are provided on the same plane.

As described above, relatively strong electric fields are formed around the conductor 12 at positions apart from the open end 12*b* of the microstrip antenna by distances corresponding to integral multiples of a half of the design wavelength, along the conductor 12. Accordingly, each of the resonators 13-1 to 13-4 is arranged at a position of a distance of substantially an integral multiple of a half of the design wavelength along the conductor 12 from the open end 12*b* of the conductor 12 so that one end of each resonator is positioned within the range in which one end of the resonator is electromagnetically coupled to the conductor 12. Thus, for a radio wave having the design wavelength, each of the resonators 13-1 to 13-4 is electromagnetically coupled to the microstrip antenna with an electric field in the vicinity of a node of the standing wave of a current that is caused to flow through the conductor 12 by the radio wave. Each of the resonators 13-1 to 13-4 may therefore radiate or receive a radio wave having the design wavelength. Additionally, the longitudinal directions of the resonators 13-1 to 13-4 are arranged to be orthogonal to the longitudinal direction of the conductor 12. Each of the resonators 13-1 to 13-4 may therefore form an electric field that extends in a different direction from an electric field caused by the microstrip antenna. As a result, the uniformity and the intensity of the electric field in the vicinity of the surface of the shelf antenna 1 are improved as compared to the electric field caused by only the microstrip antenna.

However, the phase of a current flowing through the microstrip line is reversed between positions located at intervals of a half of the design wavelength on the conductor 12. Therefore, when two resonators are arranged at an interval of a half of the design wavelength on the same side with respect to the width direction of the conductor 12, currents flowing through the two resonators have opposite phases, that is, the directions of the flowing currents are reversed. As a result, electric fields produced by the two resonators cancel out each other. In contrast, when two resonators are arranged at an interval of an integral multiple of the design wavelength on the same side with respect to the width direction of the conductor 12, currents flowing through the two resonators are in phase, that is, the directions of the flowing currents are the same. Likewise, when two resonators are arranged in such a manner as to sandwich the conductor 12 therebetween at intervals of a half of the design wavelength, the directions of currents flowing through the two resonators are also the same. When the directions of currents flowing through two resonators are the same, respective electric fields produced by the resonators reinforce each other. Accordingly, in this embodiment, resonators are alternately arranged in such a manner as to sandwich the conductor 12 therebetween. Two adjacent resonators are arranged so that their one ends are positioned within ranges in which electromagnetic coupling to the conductor 12 is possible in the vicinities of two adjacent nodal points of the conductor 12, respectively. Accordingly, the interval between ends of two adjacent resonators on the side where the ends are electromagnetically coupled to the conductor 12 is approximately a half of the design wavelength. Specifically, the resonator 13-1 is arranged in the vicinity of a position apart from the open end 12*b* by a distance of a half of the design wavelength, $\lambda/2$. The resonator 13-2 is arranged in the vicinity of a position apart from the resonator 13-1 by a distance of $\lambda$ on the same side as the resonator 13-1. In contrast, the resonators 13-3 and 13-4 are arranged in the vicinities of positions apart from the resonators 13-1 and 13-2 by a distance of $\lambda/2$, respectively, on a side of the conductor 12 opposite to the resonators 13-1 and 13-2. That is, the resonators 13-3 and 13-4 are arranged in the vicinities of positions apart from the open end 12*b* by $\lambda$ and $2\lambda$, respectively.

Each of the resonators 13-1 to 13-4 is formed in the shape of a loop, and has a length of approximately a half of the design wavelength along the longitudinal direction as illustrated in FIG. 3. The current that is caused to flow through each resonator by a radio wave radiated or received by the shelf antenna 1 is an alternating current, and therefore the phase is reversed for each half of the wavelength of the alternating current, that is, the direction of the current is reversed. Therefore, in a resonator formed in a loop shape having a length of approximately a half of the design wavelength along the longitudinal direction, the directions of a current flowing in two portions along the longitudinal direction of that resonator are the same. Therefore, the electric fields produced at the two portions, respectively, may reinforce each other.

Figure 4:
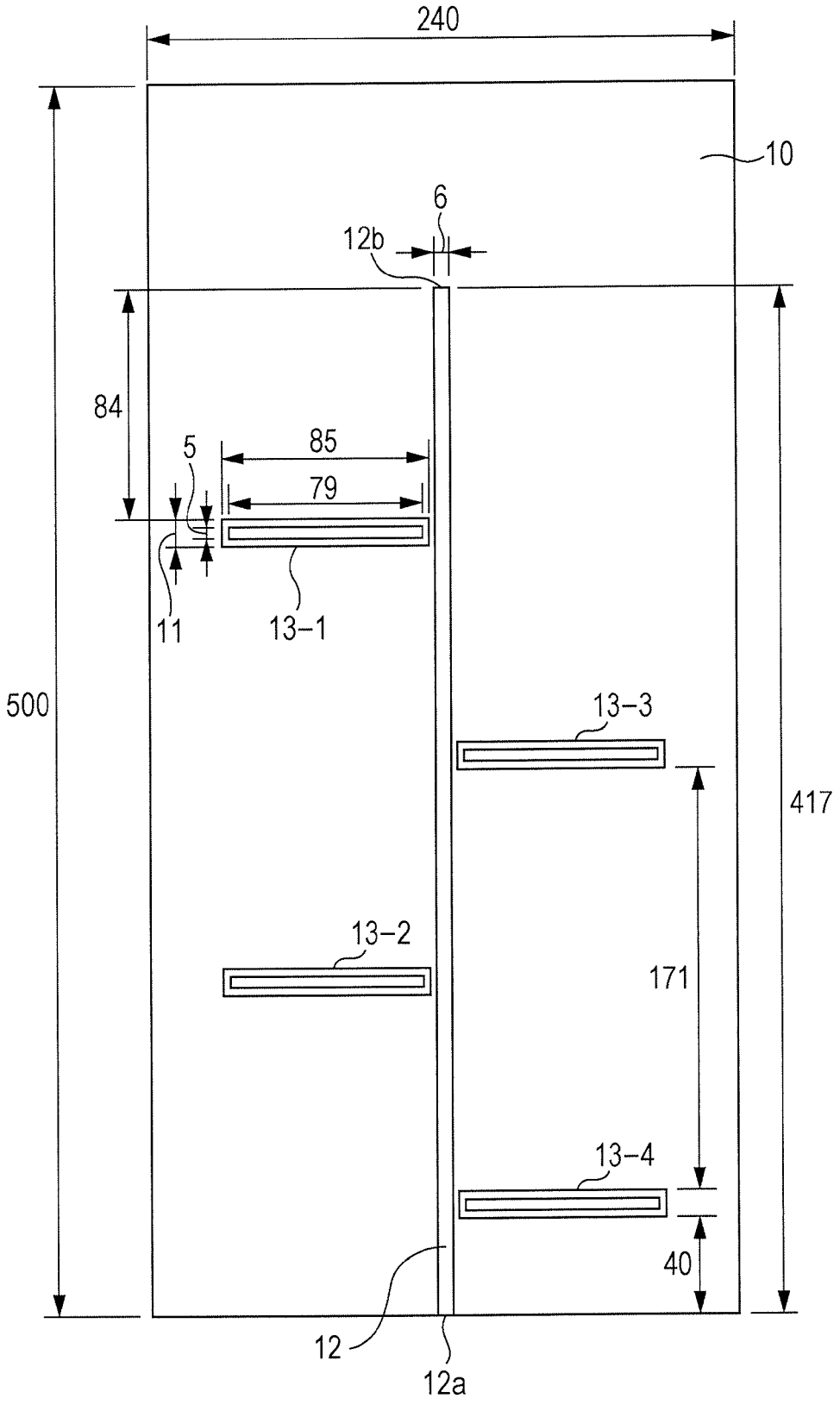
FIG. 4 is a plan view of the shelf antenna illustrating dimensions of elements used for simulation of antenna characteristics of the shelf antenna according to the first embodiment.
Figure 5:
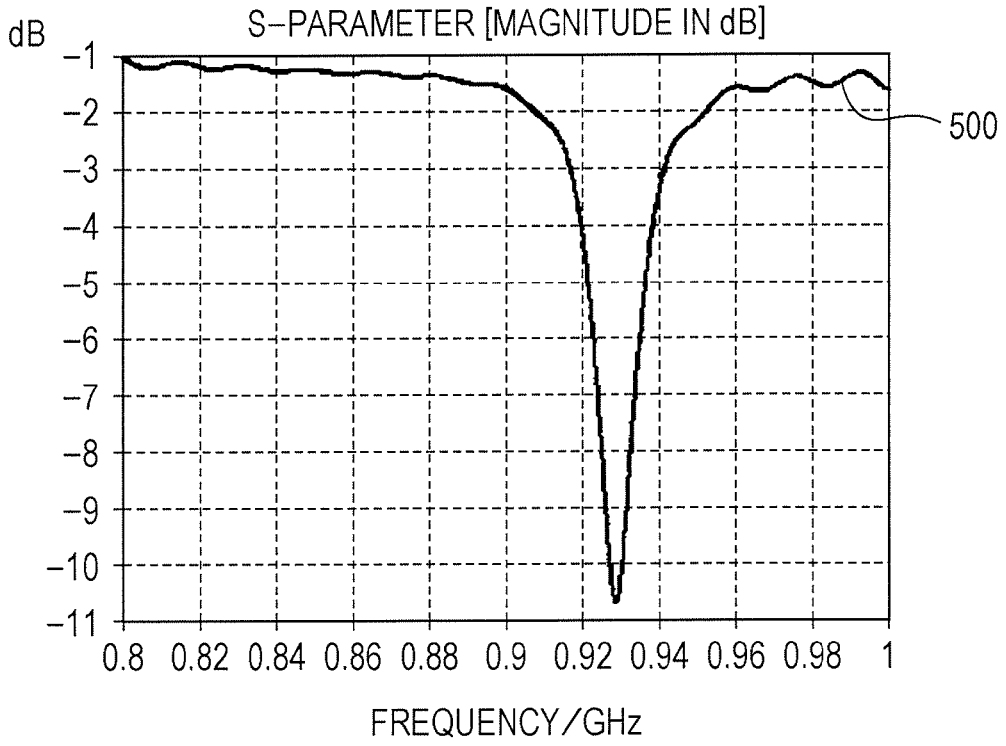
FIG. 5 is a graph depicting a simulation result of frequency characteristics of an S parameter of the shelf antenna according to the first embodiment.
Figure 6:
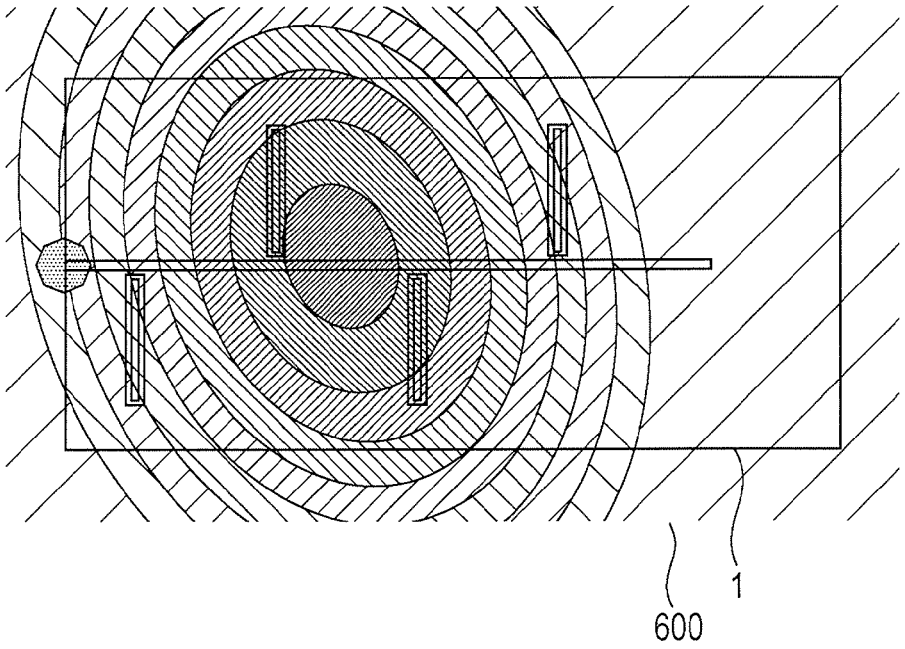
FIG. 6 is an illustration depicting a simulation result of an electric field formed in the vicinity of the surface of the shelf antenna according to the first embodiment.

A simulation result of antenna characteristics of the shelf antenna 1 will be described below. FIG. 4 is a plan view of the shelf antenna 1 illustrating dimensions of elements used for the simulation. FIG. 5 is a graph depicting a simulation result of frequency characteristics of an S parameter of the shelf antenna 1. FIG. 6 is an illustration depicting a simulation result of an electric field formed in the vicinity of the surface of the shelf antenna 1. In this simulation, a relative permittivity $\in r$ of the dielectric forming the substrate 10 is 4.0, and a dielectric loss tangent tan $\delta$ of the dielectric is 0.01. All of the ground electrode 11, the conductor 12, and the resonators 13-1 to 13-4 are formed of copper (conductivity $5.8\times10^7$ S/m).

As illustrated in FIG. 4, the substrate 10 has a length along the longitudinal direction of the conductor 12 of 500 mm, and has a length along a direction orthogonal to the longitudinal direction of the conductor 12 of 240 mm. The thickness of the substrate 10 is 3 mm. The width of the conductor 12 is 6 mm, and the length from the feeding point 12*a* to the open end 12*b* is 417 mm. The width of a conductor forming each of the resonators 13-1 to 13-4 is 3 mm, and the interval between two lines of the conductor along the longitudinal direction of each resonator is 5 mm. Additionally, the length along the longitudinal direction of each resonator is 85 mm (the interval along the longitudinal direction of the inside of a loop is 79 mm). The distance from the open end 12*b* of the conductor 12 to the resonator 13-1 is 84 mm. Additionally, the interval between the resonator 13-1 and the resonator 13-2 and the interval between the resonator 13-3 and the resonator 13-4 are each 171 mm. The distance from the resonator 13-4 to the feeding point 12*a* is 40 mm.

In FIG. 5, the horizontal axis represents the frequency [GHz], and the vertical axis represents the value [dB] of an S11 parameter. A graph 500 depicts frequency characteristics of the S11 parameter of the shelf antenna 1 obtained by simulation of an electromagnetic field using the finite integration technique. As depicted in the graph 500, it is found that, in the shelf antenna 1, the S11 parameter is at or below −10 dB, which is regarded as an indication of favorable antenna characteristics, at around 930 MHz in the 900 MHz band, which is used in RFID systems.

In FIG. 6, a graph 600 depicts the intensity distribution of an electric field of a plane parallel to the surface of the shelf antenna 1 at a position 30 cm above the surface of the shelf antenna 1. Note that the frequency of a radio wave is assumed to be 930 MHz. In the graph 600, where the higher the density is, the stronger the electric field is. As depicted in the graph 600, it is found that the electric field extends uniformly not only a direction along the longitudinal direction of the conductor 12 but also in a direction orthogonal to the longitudinal direction of the conductor 12.

As described above, in this shelf antenna, one end of the microstrip antenna is formed as an open end, and thus the current flowing through the microstrip antenna forms a standing wave. In the vicinity of a nodal point of the standing wave, one or more resonators are arranged on the same plane as a conductor forming the microstrip line, and thus the microstrip antenna and the resonators are electromagnetically coupled. Therefore, in this shelf antenna, radio waves may be radiated from both the microstrip antenna and each resonator, or may be received by both of them. This may improve the uniformity of an electric field in the vicinity of the surface of the shelf antenna and may increase the intensity of that electric field. Additionally, in this shelf antenna, the resonators and the conductor forming the microstrip line are arranged on the same plane. It is therefore unnecessary to form the substrate in a multiplayer structure. For this reason, this shelf antenna may suppress the manufacturing cost.

Note that, according to a modification, the end point 12*b* opposite to the feeding point 12*a* of the conductor 12 may be, for example, shorted through a via formed in the substrate 10 to the ground electrode 11. In this case, the end point 12*b* serves as a fixed end for a current flowing through the microstrip line. For this reason, using the end point 12*b* as a fixed end, the position of a nodal point of a current flowing through the conductor 12 is identified. In other words, a position apart from the end point 12*b* by a distance of $(\frac{1}{4}+n/2)\lambda$ (where n is an integer of zero or greater, and $\lambda$ is the design wavelength) along the longitudinal direction of the conductor 12 is the position of a nodal point. All the resonators are alternately arranged in such a manner as to sandwich the conductor 12 therebetween, in order from a position apart from the end point 12*b* by $\frac{1}{4}\lambda$ along the longitudinal direction of the conductor 12 so that the interval between adjacent resonators is $\lambda/2$.

Figure 7:
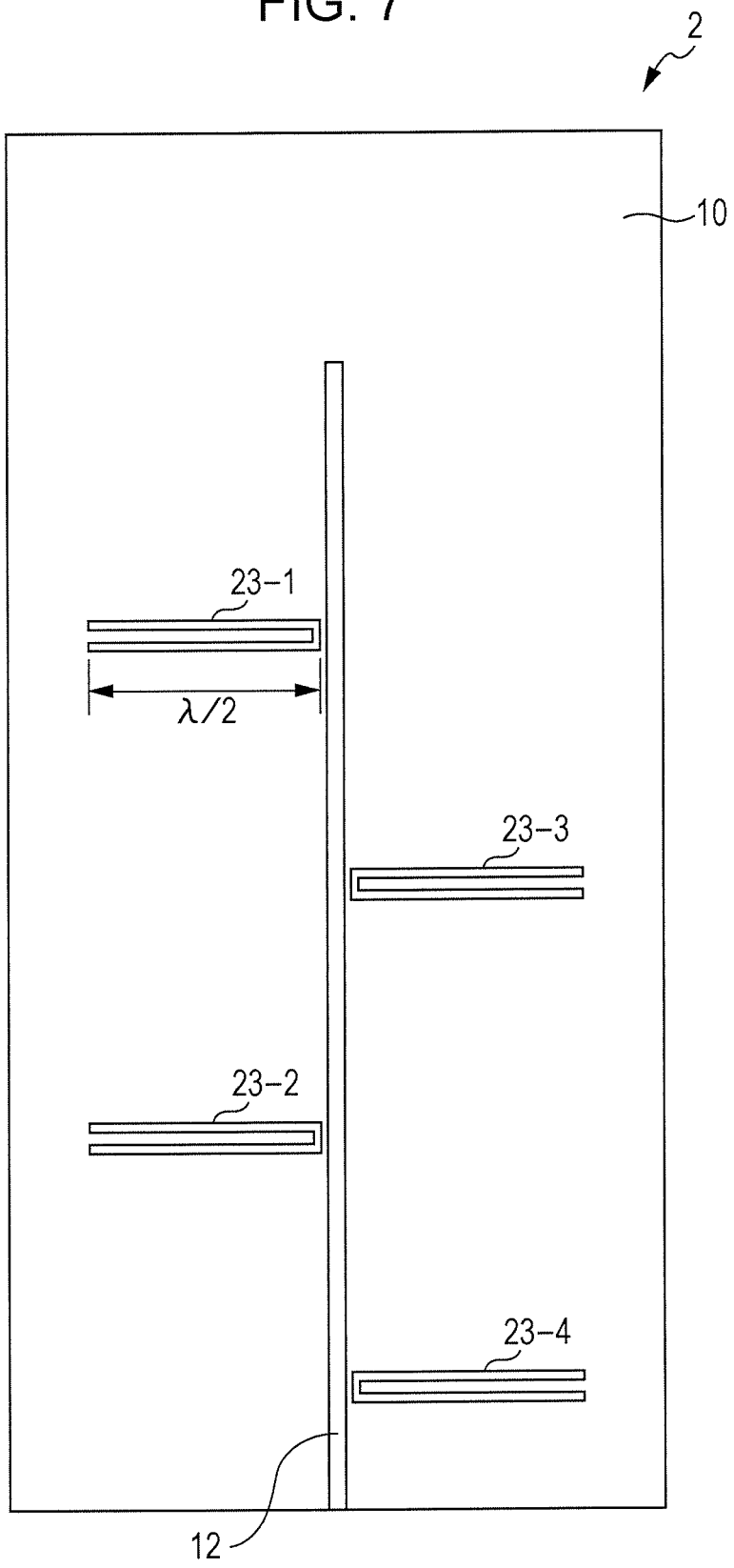
FIG. 7 is a plan view of a shelf antenna according to a modification of the first embodiment.

According to another modification, the shape of each resonator is not limited to the loop shape. FIG. 7 is a plan view of a shelf antenna 2 according to this modification. The shelf antenna 2 differs from the shelf antenna 1 according to the foregoing embodiment only in the shape of a resonator. Accordingly, a resonator will be described below. In this modification, each of resonators 23-1 to 23-4 is a dipole antenna formed in the shape of a hairpin as illustrated in FIG. 7, and differs in that an end on the side remote from the conductor 12 is opened, from each of the resonator 13-1 to 13-4 depicted in FIG. 1. However, also in this example, the length in the longitudinal direction of each of the resonators 23-1 to 23-4 is set to a half of the design wavelength. The resonators are alternately arranged in such a manner as to sandwich the conductor 12 therebetween on the upper surface of the substrate 10. Two adjacent resonators are arranged so that the interval between ends thereof on the side where these resonators are electromagnetically coupled to the conductor 12 is a half of the design wavelength. In other words, two adjacent resonators are arranged so that their respective one ends are positioned within ranges in which electromagnetic coupling to the conductor 12 is possible in the vicinities of two adjacent nodal points of the conductor 12, respectively.

Figure 8:
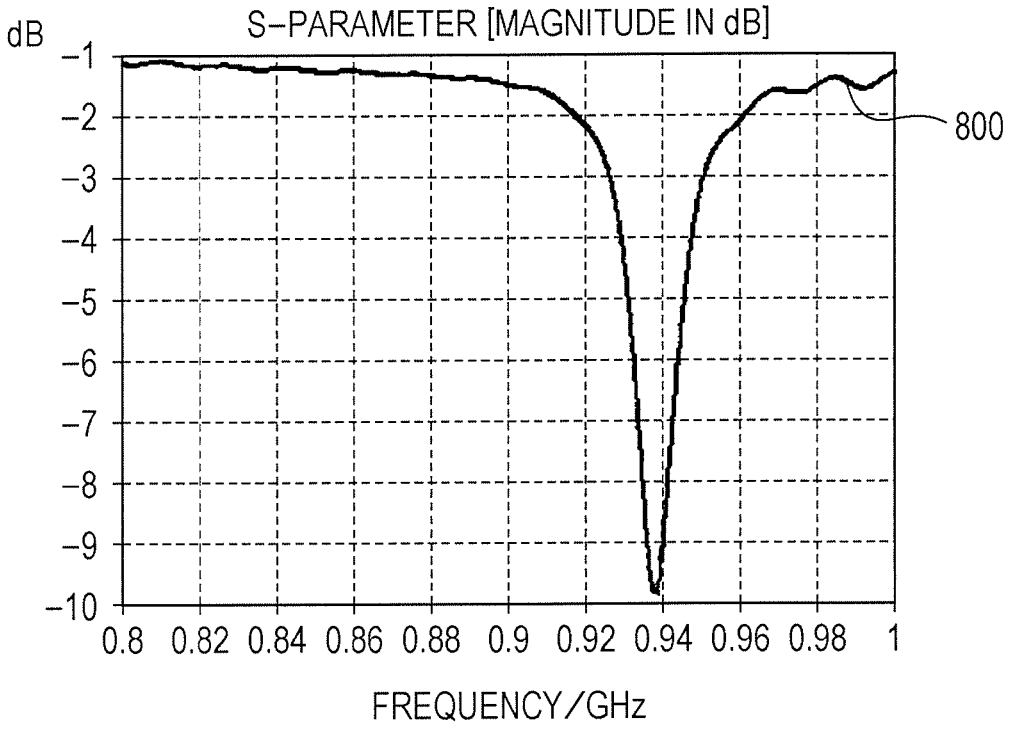
FIG. 8 is a graph depicting a simulation result of frequency characteristics of an S parameter of the shelf antenna according to the modification depicted in FIG. 7.
Figure 9:
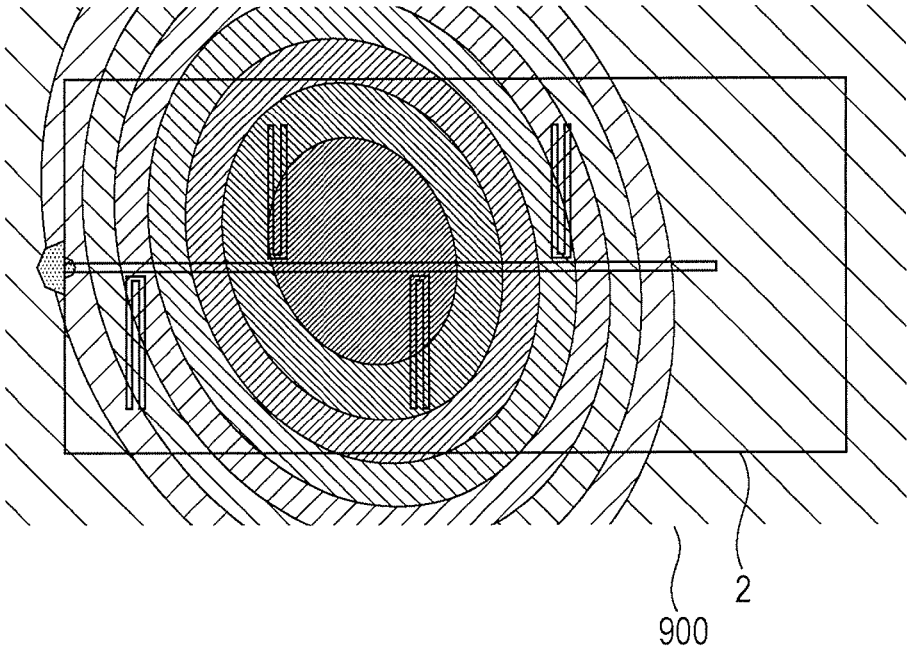
FIG. 9 is an illustration depicting a simulation result of an electric field formed in the vicinity of the surface of the shelf antenna according to the modification depicted in FIG. 7.

FIG. 8 is a graph depicting a simulation result of frequency characteristics of an S parameter of the shelf antenna 2. FIG. 9 is an illustration depicting a simulation result of an electric field formed in the vicinity of the surface of the shelf antenna 2. Note that, in the simulation of FIG. 8 and FIG. 9, the dimensions and the electric characteristics of each element are assumed to be the same as the dimensions and the electric characteristics of each element in the simulation for the first embodiment.

In FIG. 8, the horizontal axis represents the frequency [GHz], and the vertical axis represents the value [dB] of an S11 parameter. A graph 800 depicts frequency characteristics of the S11 parameter of the shelf antenna 2 obtained by simulation of an electromagnetic field using the finite integration technique. As depicted in the graph 800, it is found that, in the shelf antenna 2, the S11 parameter is approximately −10 dB at around 940 MHz.

In FIG. 9, a graph 900 depicts the intensity distribution of an electric field of a plane parallel to the surface of the shelf antenna 2 at a position 30 cm above the surface of the shelf antenna 2. Note, however, that the frequency of a radio wave is assumed to be 940 MHz. In the graph 900, where the higher the density is, the stronger the electric field is. As depicted in the graph 900, it is found that the electric field extends uniformly not only a direction along the longitudinal direction of the conductor 12 but also in a direction orthogonal to the longitudinal direction of the conductor 12.

Figure 10:
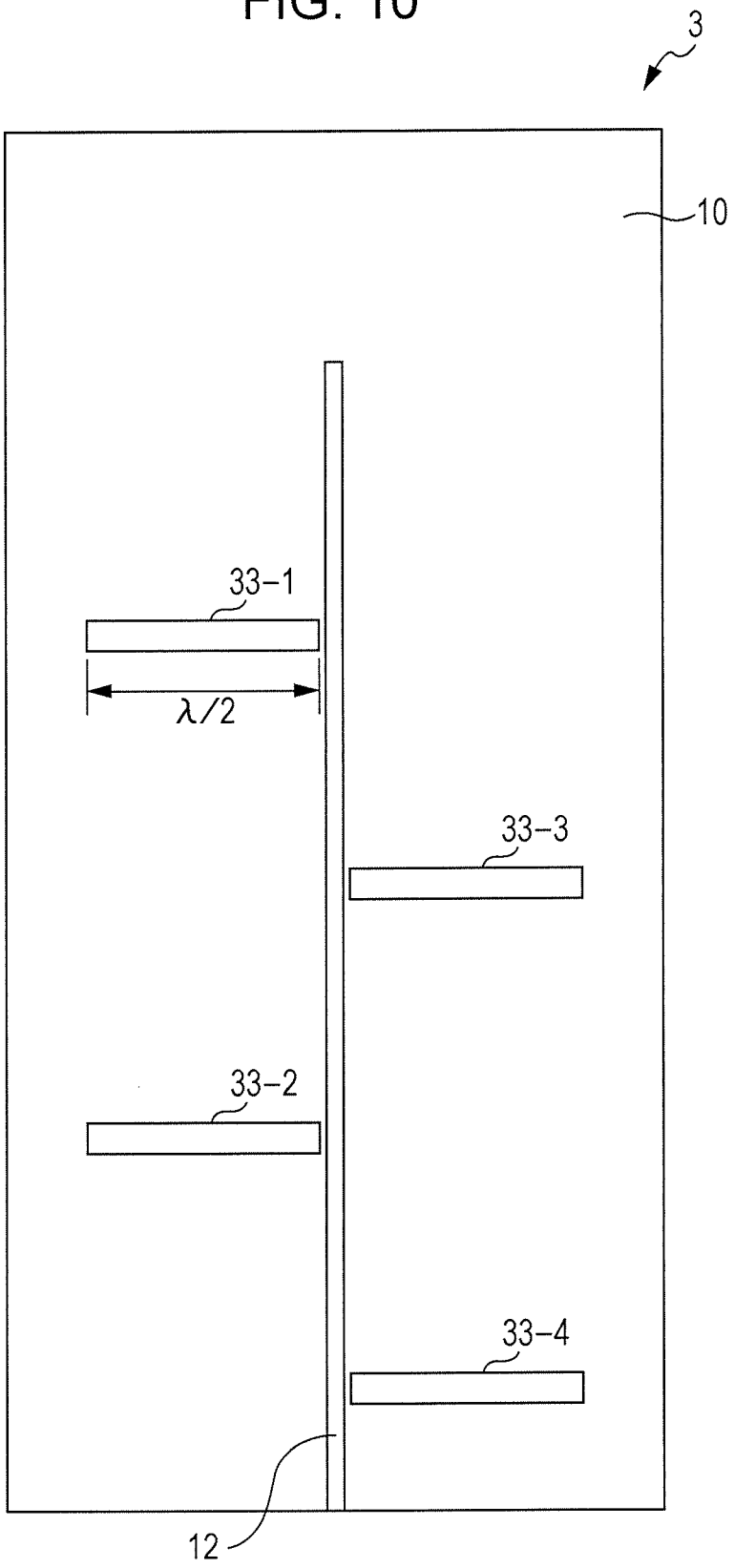
FIG. 10 is a plan view of a shelf antenna according to a further modification of the first embodiment.

A resonator may be a dipole antenna having a length of a half of the design wavelength. FIG. 10 is a plan view of a shelf antenna 3 according to this modification. The shelf antenna 3 differs from the shelf antenna 1 according to the first embodiment only in the shape of a resonator. Accordingly, a resonator will be described below. In this modification, each of resonators 33-1 to 33-4 is a dipole antenna formed of a linear conductor. However, also in this example, the length in the longitudinal direction of each of resonators 33-1 to 33-4 is set to a half of the design wavelength. The resonators are alternately arranged in such a manner as to sandwich the conductor 12 therebetween on the upper surface of the substrate 10. Two adjacent resonators are arranged so that the interval between ends thereof on the side where the resonators are electromagnetically coupled to the conductor 12 is a half of the design wavelength. In other words, two adjacent resonators are arranged so that their respective one ends are positioned within ranges in which electromagnetic coupling to the conductor 12 is possible in vicinities of two adjacent nodal points of the conductor 12, respectively. In this modification, in order for each of the resonators 33-1 to 33-4 to be electromagnetically coupled to the microstrip line, the interval between each resonator and the conductor 12 forming the microstrip line is preferably narrower than the interval between the resonator according to the first embodiment or the aforementioned modification and the conductor.

Figure 11:
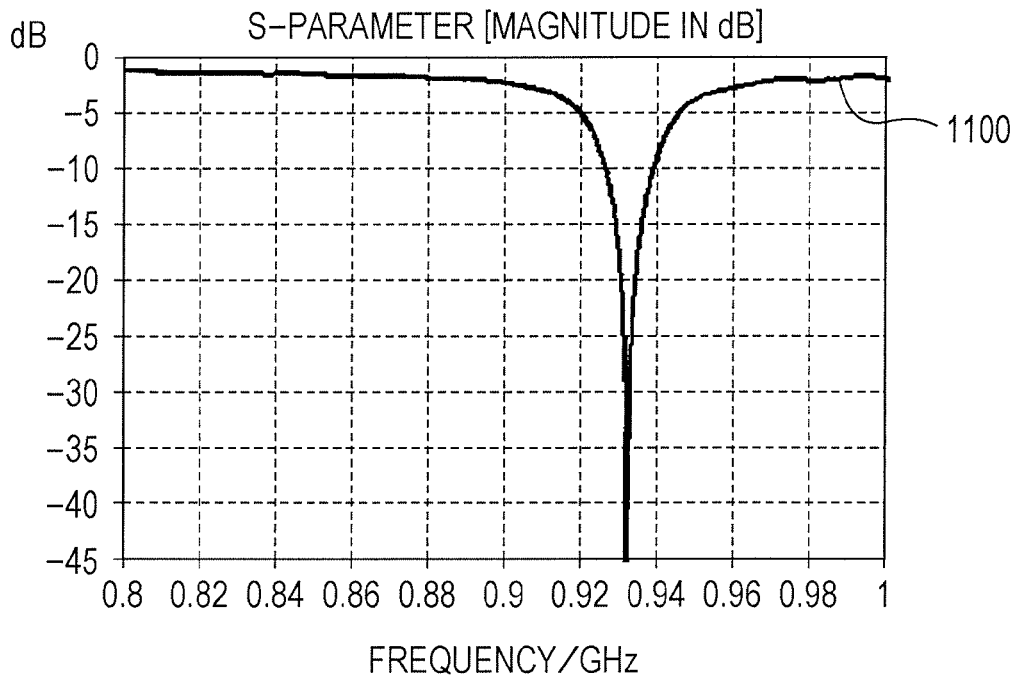
FIG. 11 is a graph depicting a simulation result of frequency characteristics of an S parameter of the shelf antenna according to the modification depicted in FIG. 10.
Figure 12:
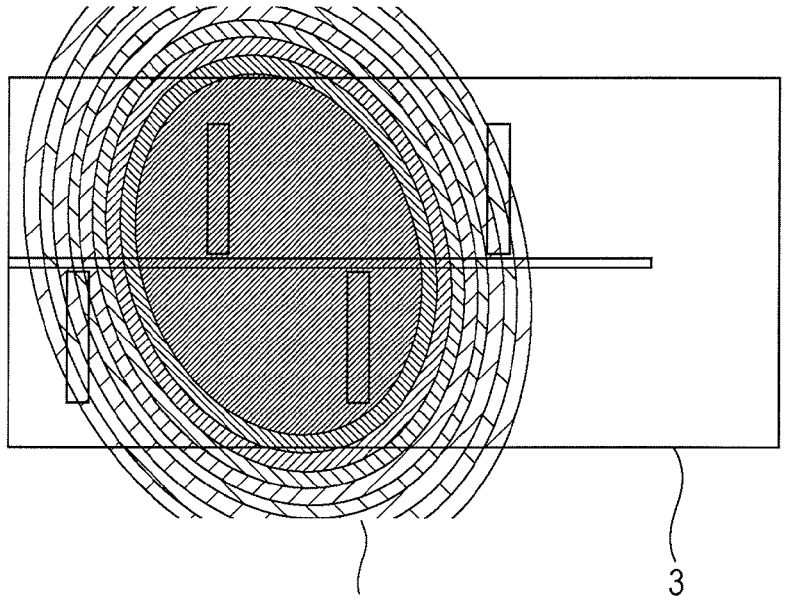
FIG. 12 is an illustration depicting a simulation result of an electric field formed in the vicinity of the surface of the shelf antenna according to the modification depicted in FIG. 10.

FIG. 11 is a graph depicting a simulation result of frequency characteristics of an S parameter of the shelf antenna 3. FIG. 12 is an illustration depicting a simulation result of an electric field formed in the vicinity of the surface of the shelf antenna 3. Note that, in the simulation of FIG. 11 and FIG. 12, the dimensions and the electric characteristics of each element differ from the dimensions and the electric characteristics of each element in the simulation for the first embodiment only in the dimensions and arrangement of resonators. In this simulation, the width of a conductor forming each of the resonators 33-1 to 33-4 is 15 mm, and the length of each resonator along the longitudinal direction thereof is 83.3 mm. Additionally, the interval between the resonator 33-1 and the resonator 33-2 and the interval between the resonator 33-3 and the resonator 33-4 are each assumed to be 167 mm. The distances from the feeding point 12*a* to the resonators 33-2 and 33-4 are assumed to be 129 mm and 38 mm, respectively. In addition, the interval between each resonator and the conductor 12 is assumed to be 1.5 mm.

In FIG. 11, the horizontal axis represents the frequency [GHz], and the vertical axis represents the value [dB] of an S11 parameter. A graph 1100 depicts frequency characteristics of the S11 parameter of the shelf antenna 3 obtained by simulation of an electromagnetic field using the finite integration technique. As depicted in the graph 1100, it is found that, in the shelf antenna 3, the S11 parameter is at or below −10 dB around 930 MHz.

In FIG. 12, a graph 1200 depicts the intensity distribution of an electric field of a plane parallel to the surface of the shelf antenna 3 at a position 30 cm above the surface of the shelf antenna 3. Note, however, that the frequency of a radio wave is assumed to be 940 MHz. In the graph 1200, where the higher the density is, the stronger the electric field is. As depicted in the graph 1200, it is found that the electric field extends uniformly not only a direction along the longitudinal direction of the conductor 12 but also in a direction orthogonal to the longitudinal direction of the conductor 12.

Note that, in the foregoing embodiment or modifications, each resonator may be arranged in a tilted manner so that, as the distance from the conductor 12, which forms the microstrip line, increases, the resonator approaches the feeding point or becomes more distant from the feeding point. Alternatively, each resonator may be formed, for example, in the shape of a curve, an arc, or a meandering line. However, even in the case where each resonator is formed in the shape of a curve, it is preferable that the length along the longitudinal direction of each resonator be approximately a half of the design wavelength. This is because, when the length along the longitudinal direction of a resonator exceeds a half of the design wavelength, there are portions where the directions of a current flowing in the resonator are different, and therefore electric fields produced from the portions with different current directions cancel out each other, thereby weakening the electric fields.

Next, a shelf antenna according to a second embodiment will be described. The shelf antenna according to the second embodiment differs, from the shelf antenna according to the first embodiment, in that resonators are arranged so that an electric field produced is circular polarization. Accordingly, elements related to a resonator will be described below. For other elements of the shelf antenna according to the second embodiment, reference is to be made to description of the corresponding elements of the shelf antenna according to the first embodiment.

Figure 13:
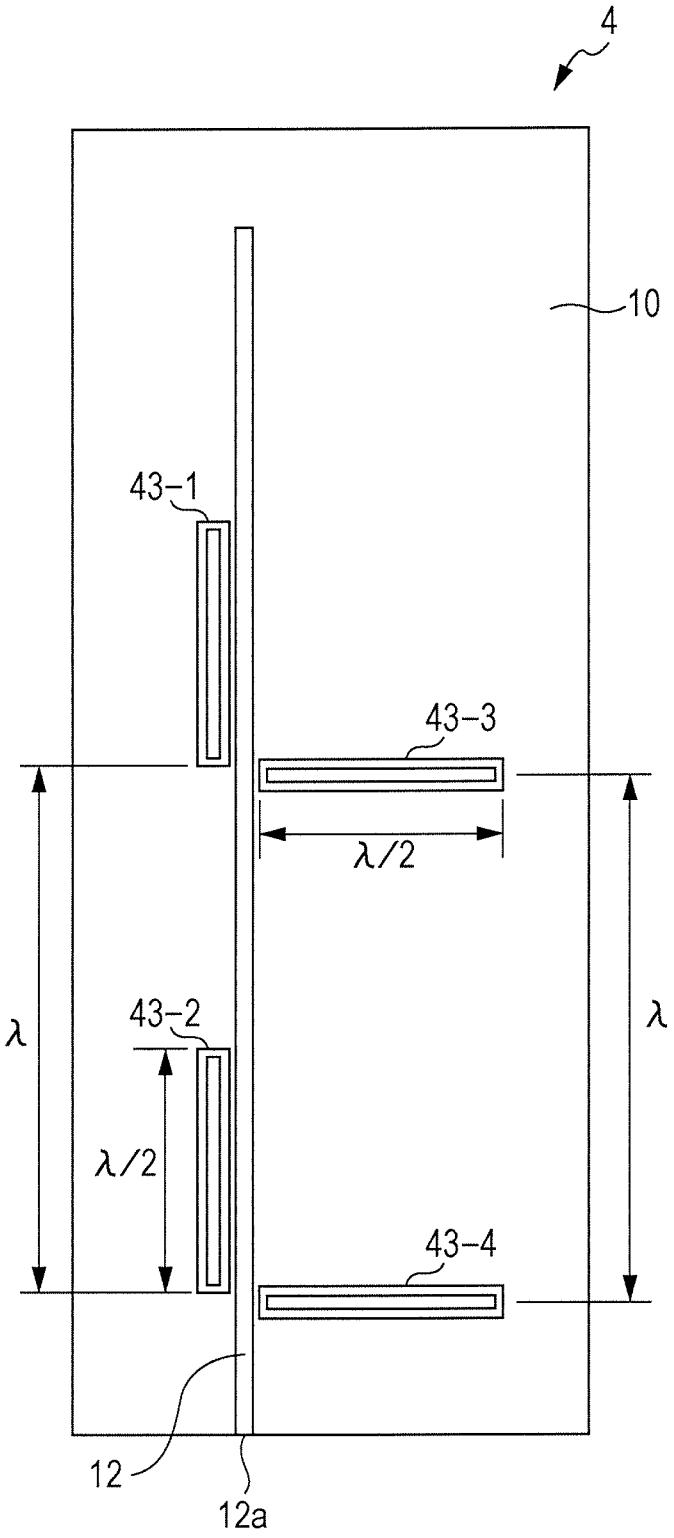
FIG. 13 is a plan view of a shelf antenna according to a second embodiment.

FIG. 13 is a plan view of the shelf antenna according to the second embodiment. In a shelf antenna 4 according to the second embodiment, each of four resonators 43-1 to 43-4 is formed of a loop-shaped conductor having a length of approximately a half of the design wavelength along the longitudinal direction, and is provided on the upper surface of the substrate 10. That is, each of the resonators 43-1 to 43-4 and the conductor 12 are arranged on the same plane. However, unlike the shelf antenna 1 according to the first embodiment, in the shelf antenna 4, the resonator 43-1 and 43-2 are arranged so that the longitudinal directions thereof are substantially parallel with the longitudinal direction of the conductor 12. In other words, the resonator 43-1 and 43-2 are arranged so as to be substantially orthogonal to the resonators 43-3 and 43-4. The resonators 43-1 and 43-2 are further arranged so as to be close to antinode portions of the standing wave of a current flowing through the microstrip line, that is, portions where the magnetic field produced by the current flowing through the microstrip line is maximized. One end of the resonator 43-1 and one end of the resonator 43-2 are arranged in the vicinities of nodes of the standing wave of the current flowing through the microstrip line, where the resonators 43-3 and 43-4 are arranged. The lengths in the longitudinal directions of the resonators 43-1 and 43-2 are each approximately a half of the design wavelength λ, and the distance from a nodal point of the standing wave to the adjacent antinode is λ/4. Therefore, the neighborhood of the center of the resonators 43-1 and 43-2 is close to the portion of an antinode of the standing wave of the current flowing through the microstrip line. Thus, with a current flowing through the microstrip line or a magnetic field produced by the current, the microstrip line and the resonators 43-1 and 43-2 are electromagnetically coupled. Note that the resonator 43-1 and 43-2 are arranged substantially in parallel with the conductor 12. For this reason, even when the interval of the resonators 43-1 and 43-2 and the conductor 12 is larger than the interval of the resonators 43-3 and 43-4 and the conductor 12, it is possible for the resonators 43-1 and 43-2 to be electromagnetically coupled to the conductor 12.

Note that the resonators 43-1 and 43-2 arranged substantially in parallel with the conductor 12 only have to be close to antinodes of the standing wave of the current flowing through the conductor 12. The position of one end of each of these resonators along the longitudinal direction of the conductor 12 may differ from the position of any resonator arranged to be substantially orthogonal to the conductor 12.

The interval between an end point of the resonator 43-1 on the side of the feeding point 12*a* and an end point of the resonator 43-2 on the side of the feeding point 12*a* is substantially equal to λ so that currents flowing through the resonators 43-1 and 43-2 are in phase. Likewise, the interval between the resonator 43-3 and the resonator 43-4 is substantially equal to λ so that the currents flowing through the resonators 43-3 and 43-4 are in phase.

As the result of arranging resonators as described above, the resonators 43-1 and 43-2 cause an electric field substantially parallel with the longitudinal direction of the conductor 12 to be produced, whereas the resonators 43-3 and 43-4 cause an electric field substantially orthogonal to the longitudinal direction of the conductor 12 to be produced. The phase of the current at a nodal point of the standing wave shifts from the phase of the current at an antinode adjacent to the nodal point by π/4. For this reason, the phase of a current flowing through the resonators 43-1 and 43-2 also shifts from the phase of a current flowing through the resonators 43-3 and 43-4 by π/4. The phase of the current flowing through each resonator varies in synchronization, and therefore an electric field produced from the resonator 43-1 and the resonator 43-3 results in circular polarization. Similarly, an electric field produced from the resonator 43-2 and the resonator 43-4 results in circular polarization. For this reason, in the vicinity of the surface of the shelf antenna 4, a combination of the intensities of components of an instantaneous electric field in a direction parallel to the longitudinal direction of the conductor 12 and the intensities of components of the instantaneous electric field in a direction orthogonal to the longitudinal direction of the conductor 12 also varies in response to the change in phase of the current flowing through each resonator. As the result of this, the directions of the instantaneous electric field also vary. For this reason, the shelf antenna 4 may make the intensities of an electric field uniform without depending on the directions of the electric field.

Figure 14:
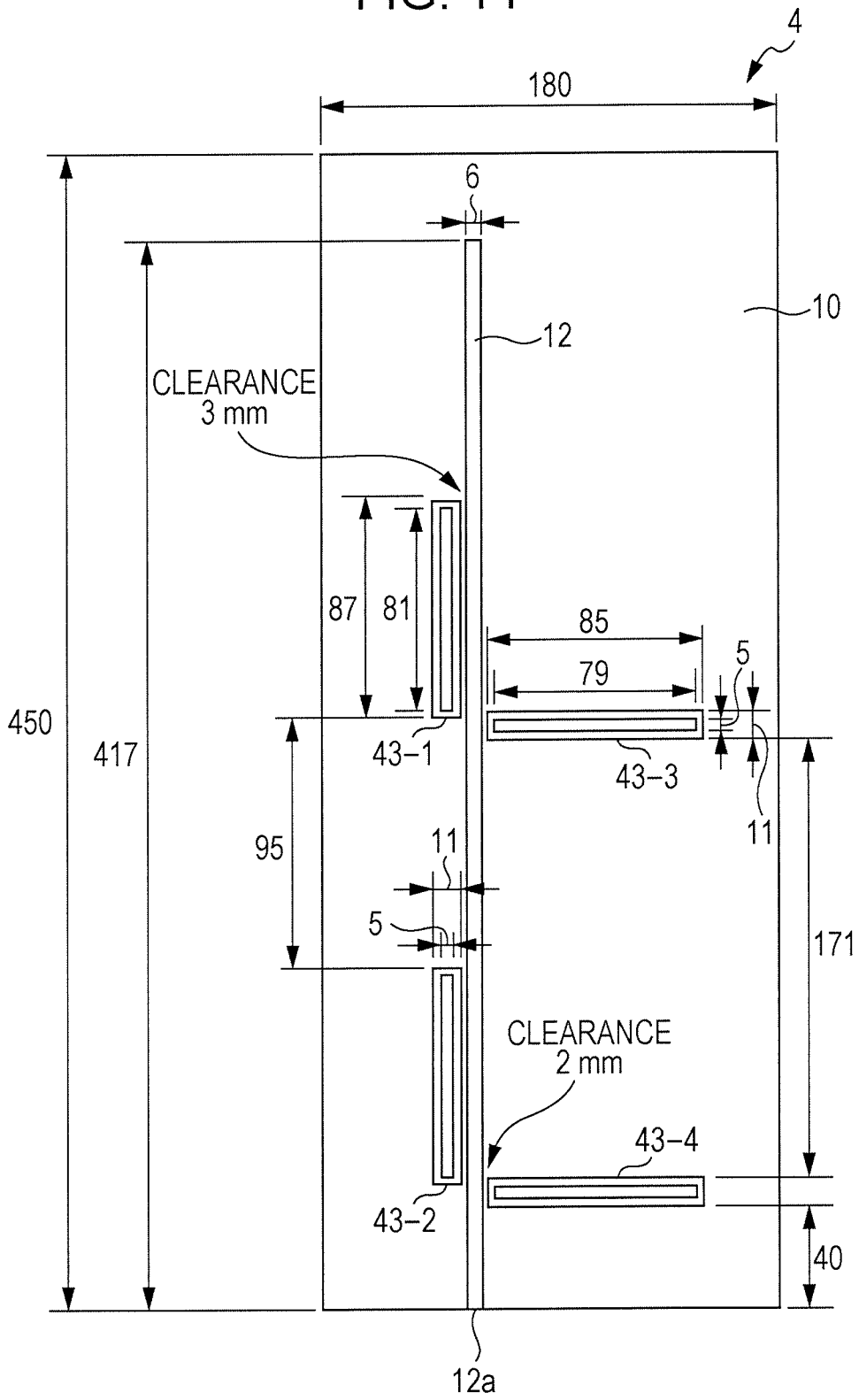
FIG. 14 is a plan view of the shelf antenna illustrating dimensions of elements used for a simulation of antenna characteristics of the shelf antenna according to the second embodiment.
Figure 15:
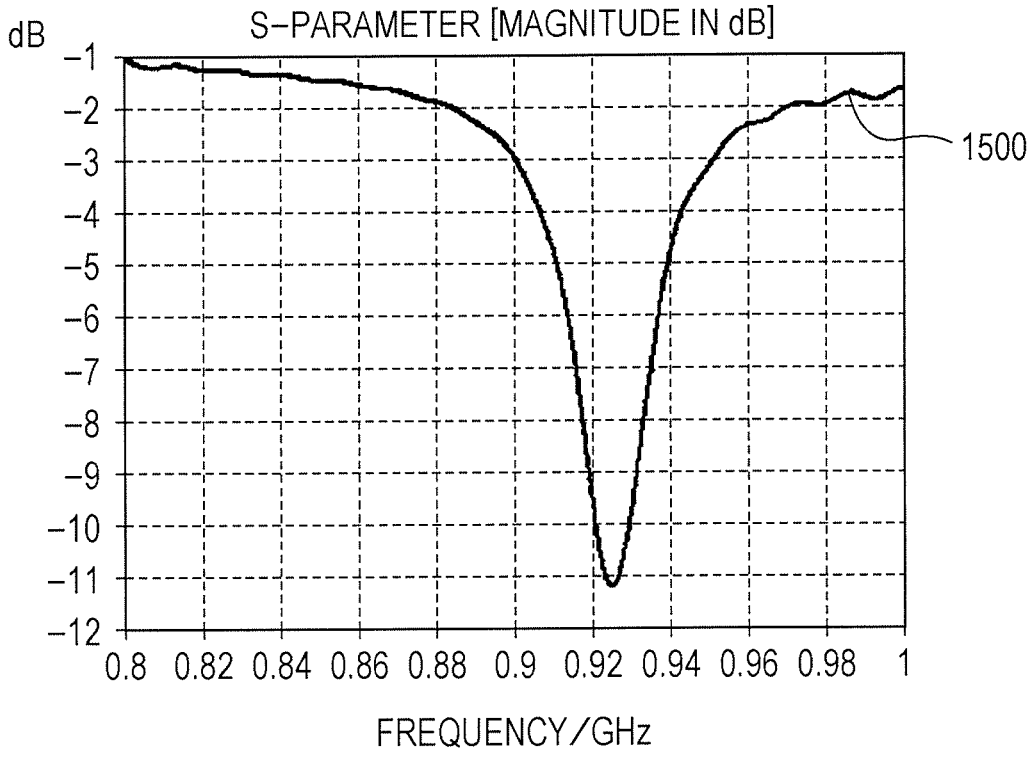
FIG. 15 is a graph depicting a simulation result of frequency characteristics of an S parameter of the shelf antenna according to the second embodiment.
Figure 16C:
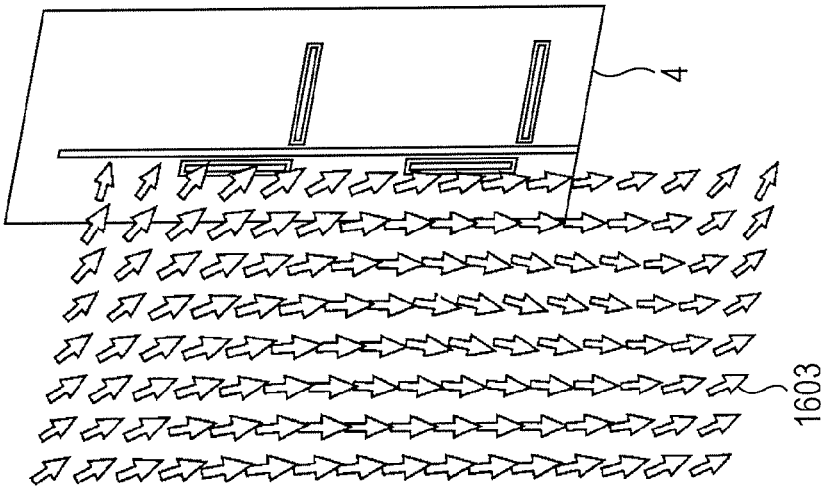
FIG. 16C is an illustration depicting the directions of the electric field in the vicinity of the surface of the shelf antenna at a certain point in time.
Figure 16B:
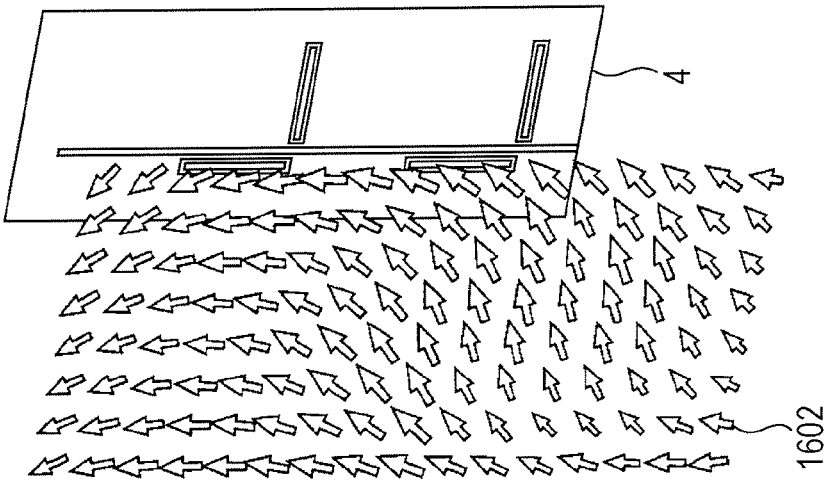
FIG. 16B is an illustration depicting the directions of the electric field in the vicinity of the surface of the shelf antenna at a certain point in time.
Figure 16A:
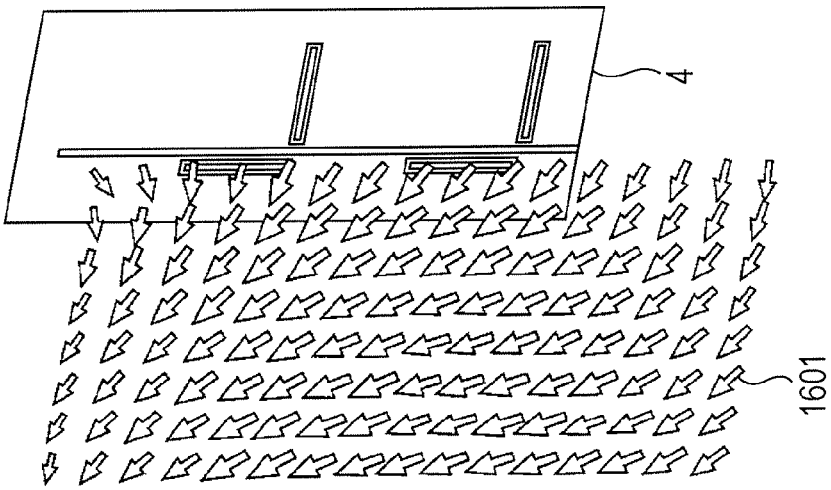
FIG. 16A is an illustration depicting the directions of an electric field in the vicinity of the surface of a shelf antenna at a certain point in time.

A simulation result of antenna characteristics of the shelf antenna 4 according to the second embodiment will be described below. FIG. 14 is a plan view of the shelf antenna 4 illustrating dimensions of elements used for the simulation of antenna characteristics of the shelf antenna 4 according to the second embodiment. FIG. 15 is a graph depicting a simulation result of frequency characteristics of an S parameter of the shelf antenna 4. FIG. 16A to FIG. 16C are illustrations depicting a simulation result of changes in time of the directions of an electric field formed in the vicinity of the surface of the shelf antenna 4. Note that, in this simulation, the dimensions and the electric characteristics of each element differ from the dimensions and the electric characteristics of each element in the first simulation only in the dimensions and arrangement of the resonators 43-1 and 43-2 and the width of the substrate 10. In this simulation, the width of the substrate 10 is 180 mm. Additionally, the lengths in the longitudinal directions of the resonators 43-1 and 43-2 are 87 mm, and the interval between the resonators 43-1 and 43-2 is 95 mm. Additionally, the distance from the feeding point 12*a* to the resonator 43-1 and the distance from the feeding point 12*a* to the resonator 43-2 are equal to the distance from the feeding point 12*a* to the resonator 43-3 and the distance from the feeding point 12*a* to the resonator 43-4, respectively. Additionally, the intervals between the resonators 43-1 and 43-2 and the conductor 12 is 3 mm, and the interval between the resonators 43-3 and 43-4 and the conductor 12 is 2 mm.

In FIG. 15, the horizontal axis represents the frequency [GHz], and the vertical axis represents the value [dB] of an S11 parameter. A graph 1500 depicts frequency characteristics of the S11 parameter of the shelf antenna 4 obtained by simulation of an electromagnetic field using the finite integration technique. As depicted in the graph 1500, it is found that, in the shelf antenna 4, the S11 parameter is at or below −10 dB at around 930 MHz.

In FIG. 16A to FIG. 16C, arrows 1601 to 1603 indicate the directions of an electric field at the positions of the arrows at different points in time in a period of time in which the phase of the current varies from 0 to 2π at a certain point on the microstrip line. As illustrated in FIG. 16A to FIG. 16C, it is found that the direction of the electric field in each element on the shelf antenna 4 varies with the elapse of time.

As described above, according to the second embodiment, the shelf antenna may make the intensities of an electric field uniform in the vicinity of the surface of the shelf antenna without depending on the directions of the electric field. When a shelf antenna communicates with another communication device, for example, an RFID tag attached to an article placed on the shelf antenna, there is a possibility that the other communication device may point in various directions with respect to the shelf antenna. However, according to this embodiment, the shelf antenna may equalize the intensities of an electric field without depending on the directions of the electric field. Therefore, the shelf antenna may achieve satisfactory communication with another communication device without depending on the direction of an antenna of the other communication device. In this shelf antenna, resonators on one side with respect to the width direction of a conductor forming the microstrip line are arranged so that the longitudinal direction of the resonators are substantially parallel with the longitudinal direction of the conductor. Therefore, the size of the resonator in a direction orthogonal to the longitudinal direction of the conductor is smaller than in the shelf antenna according to the first embodiment. Thus, the entire shelf antenna may be downsized.

In the second embodiment, as in the first embodiment, the end point 12*b* opposite to the feeding point 12*a* of the conductor 12 may be, for example, shorted through a via formed in the substrate 10 to the ground electrode 11.

According to the second embodiment, the shape of each resonator is not limited to the loop shape. The resonator may be a dipole antenna having a length of a half of the design wavelength.

Figure 17:
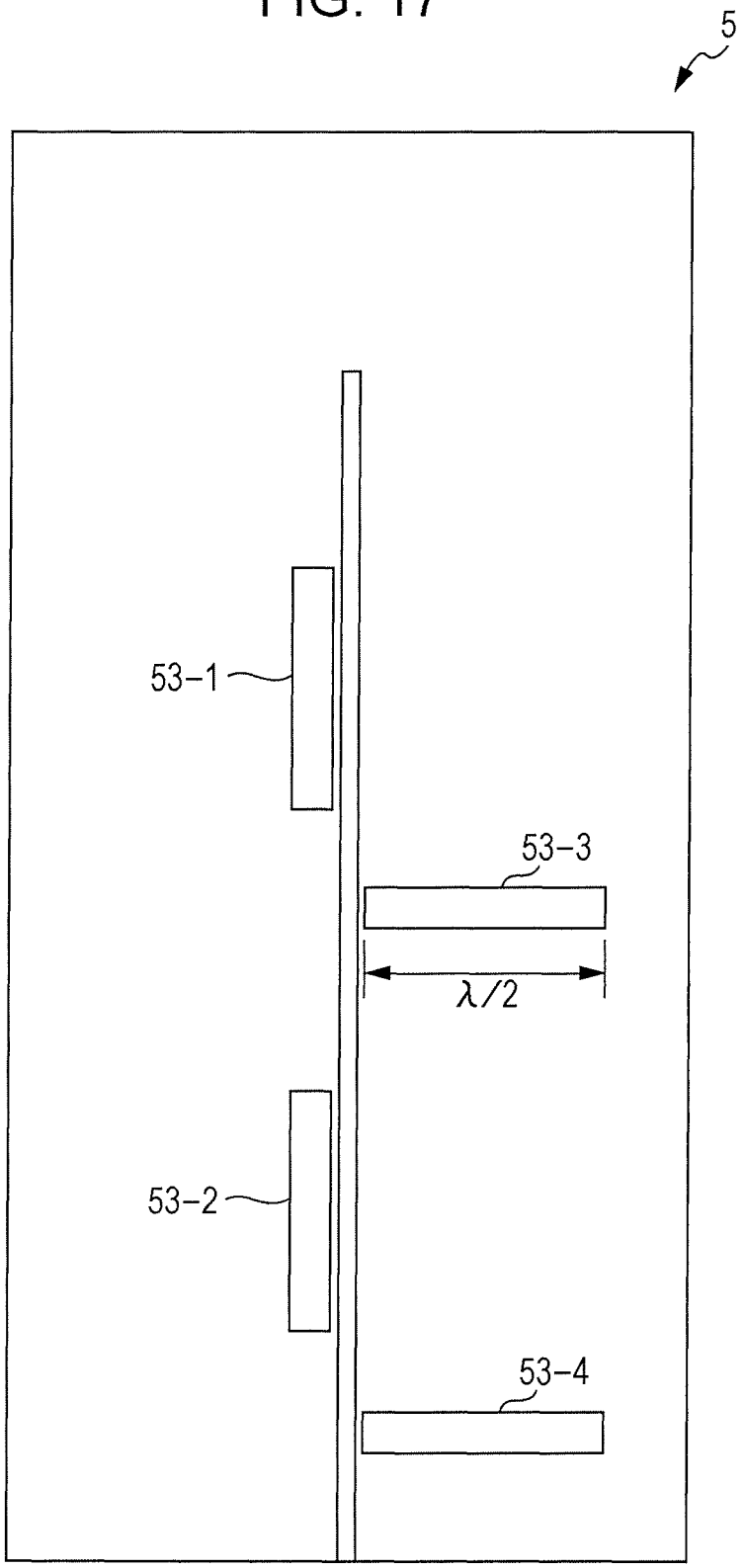
FIG. 17 is a plan view of a shelf antenna according to a modification of the second embodiment.

FIG. 17 is a plan view of a shelf antenna 5 according to this modification. The shelf antenna 5 differs from the shelf antenna 4 according to the aforementioned second embodiment only in the shape of a resonator. Accordingly, a resonator will be described below.

In this modification, each of resonators 53-1 to 53-4 is a dipole antenna formed of a linear conductor. However, also in this example, the length in the longitudinal direction of each of the resonators 53-1 to 53-4 is set to approximately a half of the design wavelength.

Figure 18:
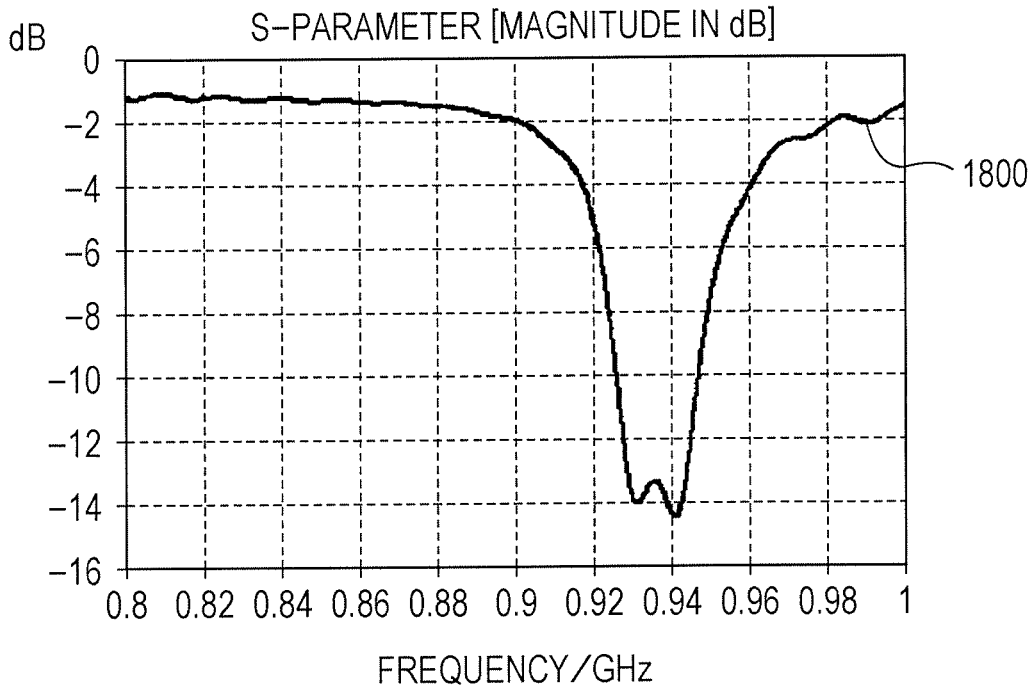
FIG. 18 is a graph depicting a simulation result of frequency characteristics of an S parameter of the shelf antenna according to the modification depicted in FIG. 17.

FIG. 18 is a graph depicting a simulation result of frequency characteristics of an S parameter of the shelf antenna 5. Note that, in the simulation of FIG. 18, the dimensions and the electric characteristics of each element differ from the dimensions and the electric characteristics of each element in the simulation for the second embodiment only in the arrangement of the resonators 53-1 and 53-2. In this simulation, the interval between the resonators 53-1 and 53-2 is 98.7 mm. The distance from the open end 12*b* of the conductor 12 to the resonator 53-1 is 69.35 mm, and the distance from the feeding point 12*a* to the resonator 53-2 is 82.35 mm. Additionally, the interval between the resonators 53-1 and 53-2 and the conductor 12 is 3 mm.

In FIG. 18, the horizontal axis represents the frequency [GHz], and the vertical axis represents the value [dB] of an S11 parameter. A graph 1800 depicts frequency characteristics of the S11 parameter of the shelf antenna 5 obtained by simulation of an electromagnetic field using the finite integration technique. As depicted in the graph 1800, it is found that, in the shelf antenna 5, the S11 parameter is at or below −10 dB near the range from 930 MHz to 950 MHz.

Figure 19:
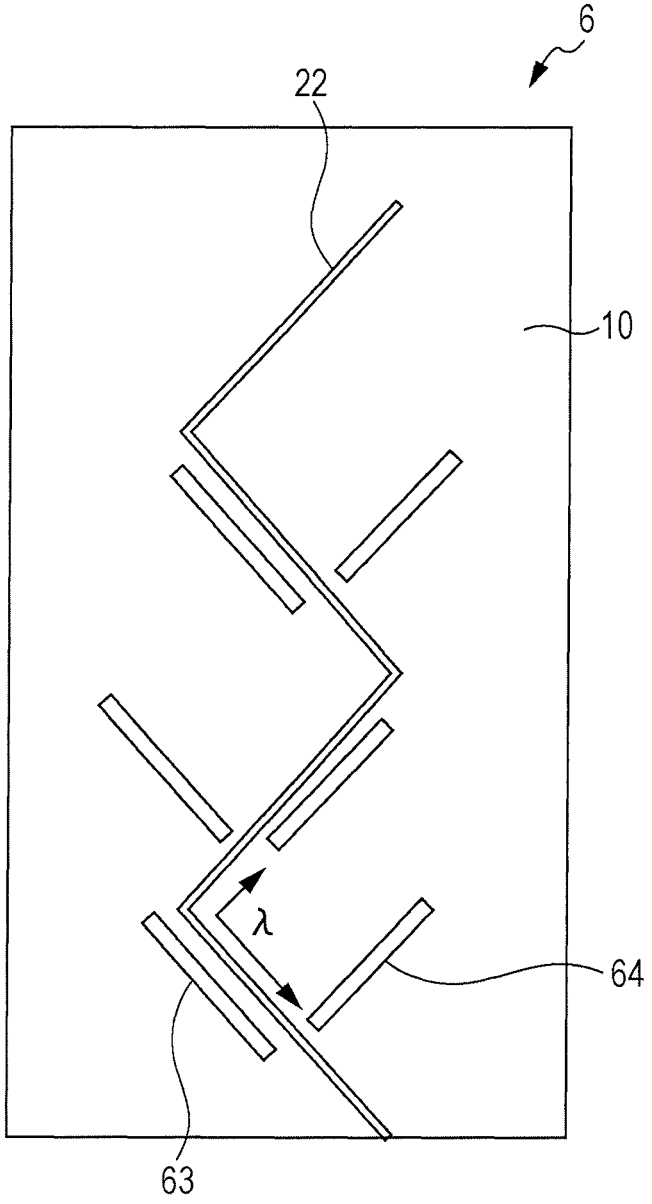
FIG. 19 is a plan view of a shelf antenna according to still another modification of the second embodiment.

FIG. 19 is a plan view of a shelf antenna 6 according to still another modification of the second embodiment. The shelf antenna 6 differs from the shelf antenna 4 illustrated in FIG. 13 in the shape of a linear conductor forming a microstrip line and arrangement of resonators.

In this modification, a conductor 22, together with a ground electrode (not depicted) provided so as to cover the entire lower surface of the substrate 10, forming a microstrip line is bent zigzag. In this example, each time a pair of a resonator 63 arranged substantially in parallel with the longitudinal direction of the conductor 22 and a resonator 64 arranged substantially orthogonal to the longitudinal direction of the conductor 22, with which a radiated radio wave is circular polarization, is arranged, the conductor 22 is bent at right angles. As in the foregoing second embodiment, each resonator 64 is arranged in the vicinity of a nodal point of the standing wave of a current flowing through the conductor 22 so that electromagnetic coupling to the conductor 22 is possible owing to the electric field. In contrast, each resonator 63 is arranged close to an antinode of the standing wave of the current flowing through the conductor 22 so that electromagnetic coupling to the conductor 22 is possible owing to the current. The distance along the conductor 22 between two adjacent resonators 64 is substantially equal to the design wavelength. However, when two resonators 64 are arranged apart from each other by the design wavelength on the same side of the conductor 22, currents flowing through the two resonators 64 that are orthogonal to each other are in phase, and therefore the electric field does not result in circular polarization. To address this, unlike the second embodiment, on the same side with respect to the width direction of the conductor 22, the resonators 63 arranged substantially in parallel with the longitudinal direction of the conductor 22 and the resonators 64 arranged to be substantially orthogonal to the longitudinal direction of the conductor 22 are alternately arranged.

In the shelf antenna 6 according to this modification, since the interval between resonators is shorter than in the second embodiment, the shelf antenna 6 may produce a stronger electric field.

Figure 20:
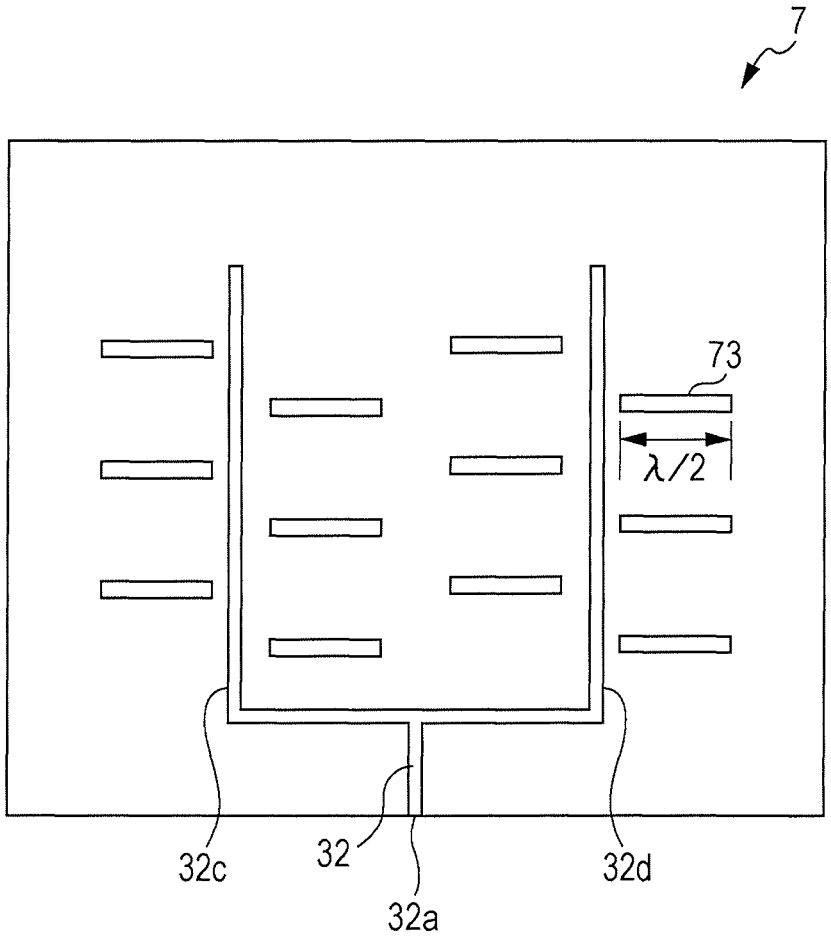
FIG. 20 is a plan view of a shelf antenna according to yet another modification of each embodiment.

FIG. 20 is a plan view of a shelf antenna 7 according to yet another modification of each of the foregoing embodiments. The shelf antenna 7 differs from the shelf antenna according to each of the foregoing embodiments or modifications in the shape of a linear conductor forming a microstrip line. In this modification, a conductor 32, together with a ground electrode (not depicted) provided so as to cover the lower surface of the substrate 10, forming the microstrip line branches in the course from a feeding point 32*a* toward the other end into two substantially parallel microstrip lines 32*c* and 32*d*. An end point of each of the microstrip lines 32*c* and 32*d* is an open end or is shorted to a ground electrode provided on the lower surface of the substrate 10, as in each of the foregoing embodiments or modifications. Also in this example, for each of the microstrip lines 32*c* and 32*d*, one or more resonators 73 each having a length of approximately a half of the design wavelength are arranged in the vicinities of nodal points of a current flowing through that microstrip line. Each of the microstrip lines 32*c* and 32*d* and each resonator 73 are electromagnetically coupled, and thus the distribution of electric fields on the surface of the substrate 10 is made uniform and reinforced. Note that each resonator 73 may be a conductor formed in the shape of a loop, or may be a dipole antenna. In this modification, the range in which the resonators and the microstrip lines are arranged is broad, and therefore the range in which transmission and reception of radio waves are possible is broader than in the foregoing embodiments or modifications.

Note that, in the foregoing embodiment or modification, a dielectric layer may be provided over the conductor 12, which forms a microstrip line, and the resonators so that the conductor 12 and the resonators are sandwiched between dielectrics. As a result, the actual length corresponding to the design wavelength of a radio wave in the conductor 12 and the resonators decreases in accordance with the relative permittivity of each dielectric. Thus, the entire antenna is more downsized.

According to still another embodiment, a distribution constant line in another form may be used in place of the microstrip line.

Figure 21:
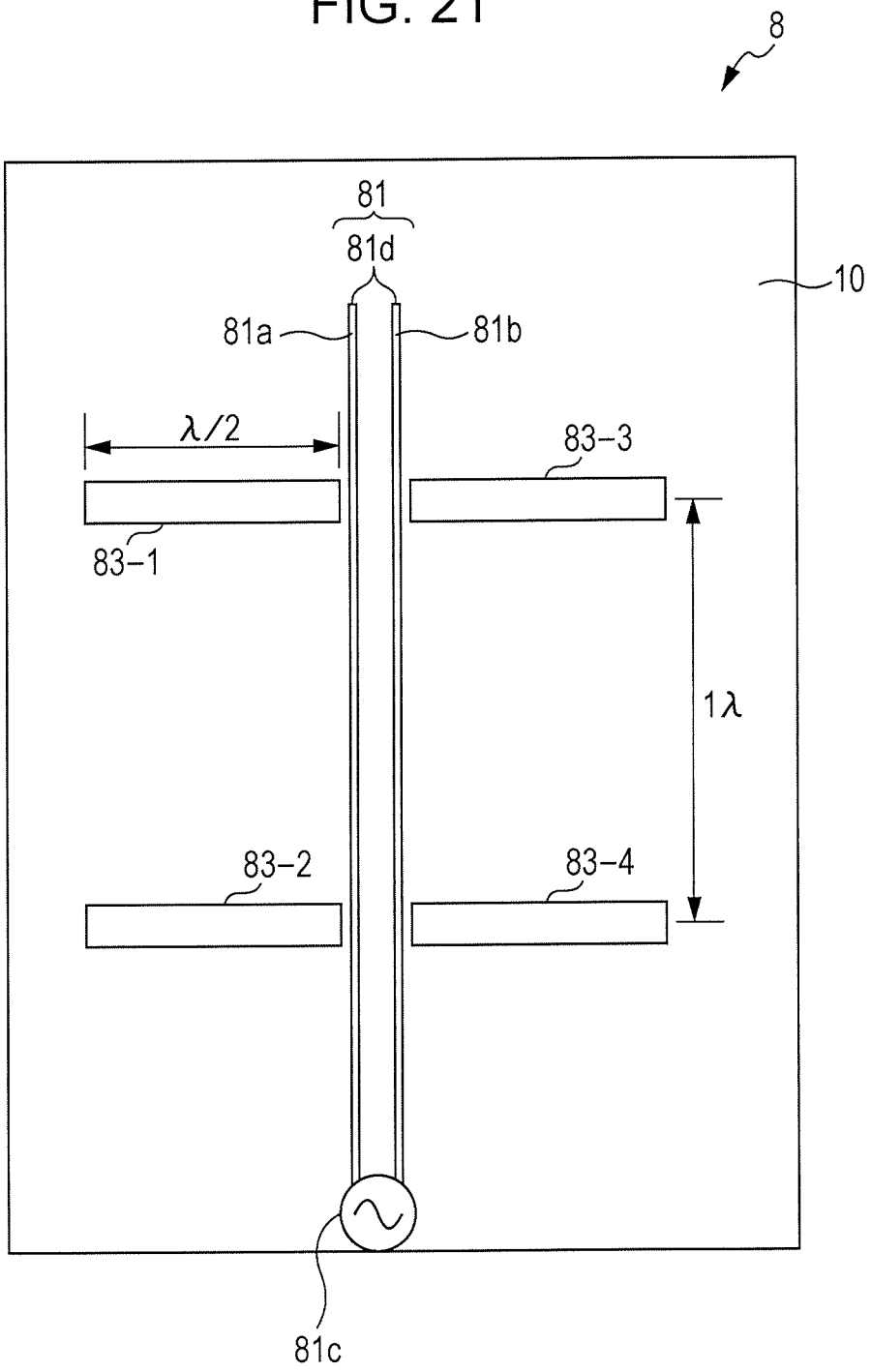
FIG. 21 is a plan view of a shelf antenna according to a third embodiment.

FIG. 21 is a plan view of a shelf antenna according to a third embodiment. In a shelf antenna 8, a Lecher wire is used as a distribution constant line in place of the microstrip line. In the shelf antenna 8, a Lecher wire 81 and resonators 83-1 to 83-4 are arranged on one surface of the substrate 10 formed of a dielectric. Note that, in this embodiment, since the Lecher wire 81 itself functions as a distribution constant line, a ground electrode does not have to be provided on the other surface of the substrate 10. For this reason, the substrate 10 is used primarily in order to support the Lecher wire 81 and the resonators 83-1 to 83-4.

The Lecher wire 81 includes two conducting wires 81*a* and 81*b* parallel with each other. The direction in which a current flows through the conducting wire 81*a* and the direction in which a current flows through the conducting wire 81*b* are opposite. Therefore, the resonator 83-1 arranged close to the conducting wire 81*a* so as to be electromagnetically coupled to the conducting wire 81*a* and the resonator 83-3 arranged close to the conducting wire 81*b* so as to be electromagnetically coupled to the conducting wire 81*b* may be arranged at the same position in the longitudinal direction of the Lecher wire 81. Likewise, the resonator 83-2 and the resonator 83-4 may be arranged at the same position in the longitudinal direction of the Lecher wire 81.

An end point 81*d* opposite to a feeding point 81*c* of the Lecher wire 81 is formed as an open end or is grounded so that the current flowing through the Lecher wire 81 forms a standing wave. The resonators 83-1 to 83-4 are each arranged so that one end of each resonator is positioned within a range in which electromagnetic coupling is possible in the vicinity of a node of the standing wave of the current flowing through the Lecher wire 81. In other words, when the end point 81*d* is an open end, the resonators 83-1 and 83-2 are arranged in the vicinities of positions apart from the end point 81*d* by integral multiples of a half of the design wavelength λ. Otherwise, when the end point 81*d* is grounded, that is, when the end point 81*d* is a fixed end, the resonators 83-1 and 83-3 are arranged in the vicinities of positions apart from the end point 81*d* by $\lambda\times(1/4+n/2)$ (where n is an integer of zero or more). Additionally, each resonator is arranged in such a manner that the interval between the resonators 83-1 and 83-3 and the resonators 83-2 and 83-4 is substantially equal to λ so that currents flowing in the resonators 83-1 and 83-4 are in phase. Also in this embodiment, the length in the longitudinal direction of each resonator is preferably approximately a half of the design wavelength.

A simulation result of antenna characteristics of the shelf antenna 8 will be described below.

Figure 22:
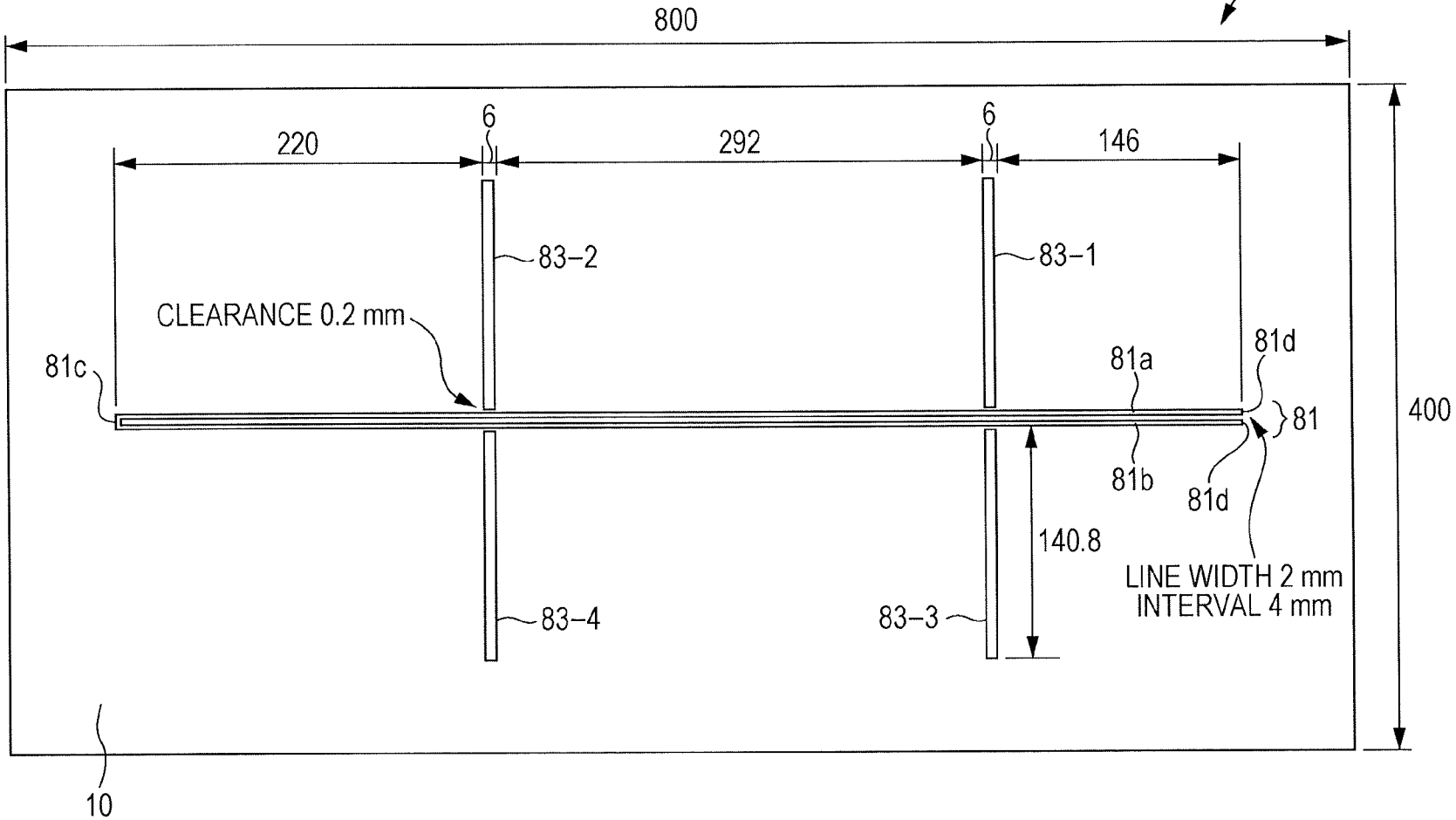
FIG. 22 is a plan view of the shelf antenna illustrating dimensions of elements used for simulation of antenna characteristics of the shelf antenna according to the third embodiment.
Figure 23:
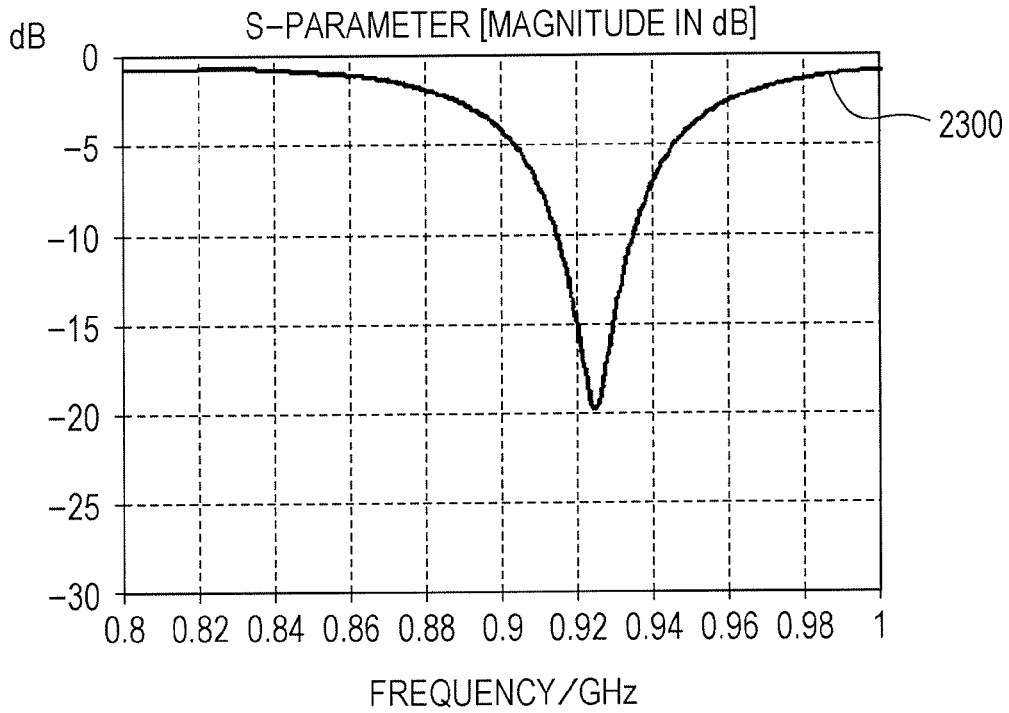
FIG. 23 is a graph depicting a simulation result of frequency characteristics of an S parameter of the shelf antenna according to the third embodiment.
Figure 24:
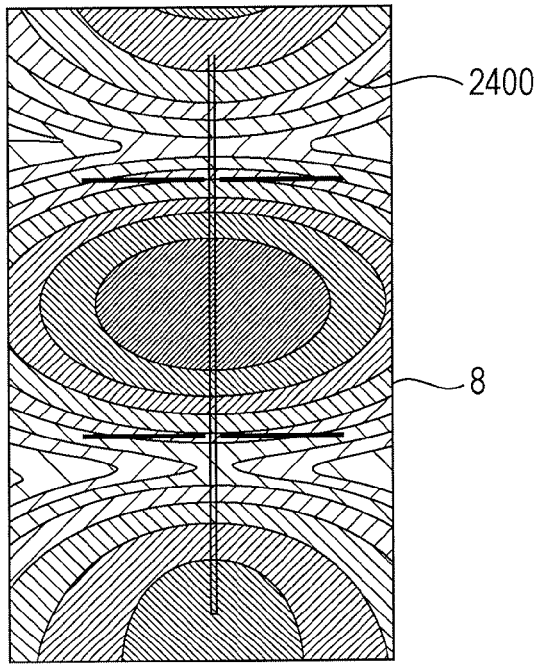
FIG. 24 is an illustration depicting a simulation result of an electric field formed in the vicinity of the surface of the shelf antenna according to the third embodiment.

FIG. 22 is a plan view of the shelf antenna 8 illustrating dimensions of elements used for the simulation. FIG. 23 is a graph depicting a simulation result of frequency characteristics of an S parameter of the shelf antenna 8. FIG. 24 is an illustration depicting a simulation result of an electric field formed in the vicinity of the surface of the shelf antenna 8. In this simulation, the relative permittivity $\in r$ of a dielectric forming the substrate 10 is 2.2, and the dielectric loss tangent tan δ sigma of the dielectric is 0.00. All the Lecher wire 81 and the resonators 83-1 to 83-4 are formed of copper (conductivity $\sigma=5.8\times10^7$ S/m).

As illustrated in FIG. 22, the substrate 10 has a length along the longitudinal direction of the Lecher wire 81 of 800 mm, and has a length along a direction orthogonal to the longitudinal direction of the Lecher wire 81 of 400 mm. The thickness of the substrate 10 is 0.6 mm.

Additionally, the widths of the conducting wires 81*a* and 81*b* of the Lecher wire 81 are each 2 mm, and the interval between the conducting wires is 4 mm. The length from the feeding point 81*c* to the open end 81*d* is 670 mm. In contrast, the width of a conductor forming each of the resonators 83-1 to 83-4 is 6 mm. Additionally, the length along the longitudinal direction of each resonator is 140.8 mm. The distance from the open end 81*d* to the resonators 83-1 and 83-3 is 146 mm. Additionally, the interval between the resonator 83-1 and the resonator 83-2 and the interval between the resonator 83-3 and the resonator 83-4 are each 292 mm. The distance from the resonators 83-2 and 83-4 to the feeding point 81*c* is 220 mm. The interval between each resonator and the Lecher wire 81 is 0.2 mm.

In FIG. 23, the horizontal axis represents the frequency [GHz], and the vertical axis represents the value [dB] of an S11 parameter. A graph 2300 depicts frequency characteristics of the S11 parameter of the shelf antenna 8 obtained by simulation of an electromagnetic field using the finite integration technique. As depicted in the graph 2300, it is found that, in the shelf antenna 8, the S11 parameter is at or below −10 dB, which is regarded as an indication of favorable antenna characteristics, at around 920 MHz.

In FIG. 24, a graph 2400 depicts the intensity distribution of an electric field of a plane parallel to the surface of the shelf antenna 8 at a position 30 cm above the surface of the shelf antenna 8. Note, however, that the frequency of a radio wave is assumed to be 920 MHz. In the graph 2400, where the higher the density is, the stronger the electric field is. As depicted in the graph 2400, it is found that the electric field extends uniformly not only in a direction along the longitudinal direction of the Lecher wire 81 but also in a direction orthogonal to the longitudinal direction of the Lecher wire 81.

According to this embodiment, a ground electrode does not have to be provided on the back of the substrate. Therefore, the thickness of the substrate does not have to be taken into consideration when the characteristic impedance of a shelf antenna is adjusted. For this reason, according to this embodiment, the thickness of a shelf antenna may be more reduced.

Note that, in each of the foregoing embodiments or modifications, the number of resonators is not limited to the illustrated number, and may be one or more.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A planar antenna comprising:

a substrate formed of a dielectric;

a distributed constant line formed on a first surface of the substrate, the distributed constant line including a first end to which power is supplied and a second end that is an open end or is grounded;

at least one first resonator, from a plurality of first resonators, is individually arranged on the first surface of the substrate and within a range in which the at least one first resonator is allowed to be electromagnetically coupled to the distributed constant line in a vicinity of any of nodal points of a standing wave of a current that flows through the distributed constant line in response to a radio wave having a certain design wavelength radiated from the distributed constant line or received by the distributed constant line;

wherein the distributed constant line is a microstrip line including a ground electrode arranged on a second surface of the substrate and a conductor arranged on the first surface of the substrate, the conductor being a linear conductor; and at least one second resonator is individually arranged in parallel with the conductor on the first surface of the substrate and within a range in which at least one second resonator is allowed to be electromagnetic coupled to the conductor in a vicinity of any of antinodes of the standing wave of the current, the at least one second resonator being individually arranged so as to be orthogonal to the at least one first resonator, wherein each of the at least one first resonator is individually arranged at a position of a distance of an integral multiple of a half of the design wavelength from the second end of the distributed constant line.

2. The planar antenna according to claim 1, wherein the plurality of first resonators being each individually arranged alternately so as to sandwich the conductor, and two adjacent first resonators of the plurality of first resonators being arranged in a range in which each of the two adjacent first resonators is allowed to be electromagnetically coupled to the distributed constant line, at respective two adjacent nodal points of a current that flows through the conductor.

3. The planar antenna according to claim 2, wherein each of the plurality of first resonators has a length of a half of the design wavelength along a longitudinal direction of the each of the plurality of first resonators.

4. The planar antenna according to claim 1, wherein each of the plurality of first resonators has a length of a half of the design wavelength along a longitudinal direction of the each of the plurality of first resonators.

5. The planar antenna according to claim 1, wherein each of the plurality of first resonators has a length of a half of the design wavelength along a longitudinal direction of the each of the plurality of first resonators.

6. The planar antenna according to claim 1, wherein the at least one second resonator includes a plurality of second resonators, and the conductor is formed so that the conductor is bent corresponding to each portion at which a pair of one of the plurality of first resonators and one of the plurality of second resonators is individually arranged, and the one of plurality of first resonators and the one of plurality second resonators are individually alternately arranged at an interval of the design wavelength on respective side of the conductor along a longitudinal direction of the conductor.

7. The planar antenna according to claim 1, wherein the distributed constant line is a Lecher wire including a first conducting wire and a second conducting wire arranged in parallel with each other on the first surface of the substrate, and wherein the plurality of first resonators further comprise a third resonator and a forth resonator, wherein the third resonator is arranged so that the third resonator is electromagnetically coupled at one end of the third resonator to the first conducting wire at a nodal point of the first conducting wire located at the distance from the second end, and the fourth resonator arranged so that the fourth resonator is electromagnetically coupled at one end of the fourth resonator to the second conducting wire at a nodal point of the second conducting wire located at the distance from the second end.

8. A planar antenna comprising:

a substrate that is formed of a dielectric;

a ground electrode formed on an entire lower surface of the substrate and that is a flat conductor;

a linear conductor formed on an upper surface of the substrate;

a first resonator formed near a first side of the liner conductor and on the upper surface of the substrate;

a second resonator formed near the first side of the liner conductor and on the upper surface of the substrate;

a third resonator formed near a second side of the liner conductor and on the upper surface of the substrate; and a fourth resonator formed near the second side of the liner conductor and on the upper surface of the substrate;

wherein the first resonator, the second resonator, the third resonator and the fourth resonator are formed of a loop-shaped conductors that have a length substantially equal to a half of the design wavelength along the longitudinal direction of each resonators and in which the length of one round is substantially equal to the design wavelength.

9. The planar antenna according to claim 8, wherein the first resonator, the second resonator, the third resonator and the fourth resonator are arranged in the vicinities of positions apart from the open end of the a linear conductor, respectively.

10. A planar antenna comprising:

a substrate that is formed of a dielectric;

a ground electrode formed on an entire lower surface of the substrate and that is a flat conductor;

a linear conductor formed on an upper surface of the substrate;

a first resonator formed near a first side of the liner conductor and on the upper surface of the substrate;

a second resonator formed near the first side of the liner conductor and on the upper surface of the substrate;

a third resonator formed near a second side of the liner conductor and on the upper surface of the substrate; and a fourth resonator formed near the second side of the liner conductor and on the upper surface of the substrate;

wherein the first resonator, the second resonator, the third resonator and the fourth resonator are dipole antennas formed in the shape of a hairpin and ends on the side remote from the linear conductor are opened.

11. The planar antenna according to claim 10, wherein the first resonator, the second resonator, the third resonator and the fourth resonator are arranged in the vicinities of positions apart from the open end of the a linear conductor, respectively.

* * * * *